US009777227B2

(12) United States Patent
Soultanidis et al.

(10) Patent No.: US 9,777,227 B2
(45) Date of Patent: Oct. 3, 2017

(54) UPGRADING HYDROCARBON PYROLYSIS PRODUCTS

(71) Applicant: ExxonMobil Chemical Patents Inc., Baytown, TX (US)

(72) Inventors: Nikolaos Soultanidis, Houston, TX (US); John S. Buchanan, Flemington, NJ (US); Christopher M. Evans, Houston, TX (US); David T. Ferrughelli, Flemington, NJ (US); Luc R. M. Martens, Meise (BE); Keith G. Reed, Houston, TX (US); Frank C. Wang, Annandale, NJ (US); Teng Xu, Houston, TX (US); Cathleen Yung, Phillipsburg, NJ (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 179 days.

(21) Appl. No.: 14/683,458

(22) Filed: Apr. 10, 2015

(65) Prior Publication Data

US 2015/0315496 A1 Nov. 5, 2015

Related U.S. Application Data

(60) Provisional application No. 61/986,316, filed on Apr. 30, 2014.

(30) Foreign Application Priority Data

Jun. 10, 2014 (EP) ..... 14171697

(51) Int. Cl.
*C10G 69/06* (2006.01)
*C10G 69/00* (2006.01)
(Continued)

(52) U.S. Cl.
CPC ..... *C10G 49/00* (2013.01); *C10G 49/22* (2013.01); *C10G 49/24* (2013.01); *C10G 69/00* (2013.01);
(Continued)

(58) Field of Classification Search
CPC ..... C10G 49/00; C10G 49/22; C10G 49/24; C10G 69/00; C10G 69/06; C10G 2300/4031; C10G 2300/4081; C10L 1/04
See application file for complete search history.

(56) References Cited

U.S. PATENT DOCUMENTS 2,382,260 A 8/1945 Schaad
4,802,972 A * 2/1989 Kukes ..... B01J 31/223 208/107
(Continued)

FOREIGN PATENT DOCUMENTS

WO 2013/033580 3/2013
WO 2013/033582 3/2013
WO 2013/033590 3/2013

*Primary Examiner* — Brian McCaig

(57) ABSTRACT

The invention relates to a utility fluid, such as a fluid containing aromatic and non-aromatic ringed molecules, useful as a diluent when hydroprocessing pyrolysis tar, such as steam cracker tar. The specified utility fluid comprises ≥10.0 wt % aromatic and non-aromatic ring compounds and each of the following: (a) ≥1.0 wt % of 1.0 ring class compounds; (b) ≥5.0 wt % of 1.5 ring class compounds; (c) ≥5.0 wt % of 2.0 ring class compounds; and (d) ≤0.1 wt % of 5.0 ring class compounds. The invention also relates to methods for producing such a utility fluid and to processes for hydroprocessing pyrolysis tar.

12 Claims, 13 Drawing Sheets

(51) Int. Cl.

| | |
|---|---|
| ***C10G 49/00*** | (2006.01) |
| ***C10G 49/22*** | (2006.01) |
| ***C10G 49/24*** | (2006.01) |
| ***C10L 1/04*** | (2006.01) |

(52) U.S. Cl.

CPC ..... *C10G 69/06* (2013.01); *C10L 1/04* (2013.01); *C10G 2300/4031* (2013.01); *C10G 2300/4081* (2013.01)

(56) References Cited

U.S. PATENT DOCUMENTS

| | | | | |
|---|---|---|---|---|
| 5,158,668 | A | 10/1992 | Chahar et al. | |
| 5,169,039 | A | 12/1992 | Kay et al. | |
| 6,569,312 | B1 * | 5/2003 | Carroll ..... | C10G 45/64 208/108 |
| 6,632,351 | B1 | 10/2003 | Ngan et al. | |
| 7,090,765 | B2 | 8/2006 | Spicer et al. | |
| 7,097,758 | B2 | 8/2006 | Stell et al. | |
| 7,138,047 | B2 | 11/2006 | Stell et al. | |
| 7,220,887 | B2 | 5/2007 | Stell et al. | |
| 7,235,705 | B2 | 6/2007 | Stell | |
| 7,244,871 | B2 | 7/2007 | Stell et al. | |
| 7,247,765 | B2 | 7/2007 | Stell et al. | |
| 7,297,833 | B2 | 11/2007 | Beattie et al. | |
| 7,311,746 | B2 | 12/2007 | Stell et al. | |
| 7,312,371 | B2 | 12/2007 | Stell et al. | |
| 7,351,872 | B2 | 4/2008 | Stell et al. | |
| 7,488,459 | B2 | 2/2009 | Stell et al. | |
| 7,578,929 | B2 | 8/2009 | Stell et al. | |
| 7,820,035 | B2 | 10/2010 | McCoy et al. | |
| 8,083,931 | B2 | 12/2011 | McCoy et al. | |
| 2011/0005970 | A1 * | 1/2011 | Ou ..... | C10G 9/007 208/44 |
| 2013/0233764 | A1 | 9/2013 | Brown et al. | |
| 2014/0061095 | A1 | 3/2014 | Beech, Jr. et al. | |
| 2014/0061096 | A1 | 3/2014 | Brown et al. | |

* cited by examiner

SCGO

UPGRADING HYDROCARBON PYROLYSIS PRODUCTS

CROSS-REFERENCE TO RELATED APPLICATIONS

This application claims priority to and the benefit of U.S. Provisional Application Ser. No. 61/986,316, filed Apr. 30, 2014 and EP 14171697.7 filed Jun. 10, 2014, the entireties are incorporated herein by reference.

FIELD

The invention relates to a utility fluid, such as a fluid containing aromatic and non-aromatic ringed molecules, useful as a diluent when hydroprocessing pyrolysis tar, such as steam cracker tar. The invention also relates to methods for producing such a utility fluid and to processes for hydroprocessing pyrolysis tar.

BACKGROUND

Pyrolysis processes, such as steam cracking, are utilized for converting saturated hydrocarbons to higher-value products such as light olefins, e.g., ethylene and propylene. Besides these useful products, hydrocarbon pyrolysis can also produce a significant amount of relatively low-value heavy products, such as pyrolysis tar. When the pyrolysis is steam cracking, the pyrolysis tar is identified as steam-cracker tar ("SCT"). Hydroprocessing pyrolysis tar in the presence of a hydrogen-containing treat gas and at least one hydroprocessing catalyst produces an upgraded pyrolysis tar having improved blending characteristics with other heavy hydrocarbons such as fuel oil.

SCT generally contains relatively high molecular weight molecules, conventionally called Tar Heavies ("TH"). Catalytic hydroprocessing of undiluted SCT leads to significant catalyst deactivation. For example, a significant decrease in hydroprocessing efficiency is observed when hydroprocessing SCT at a temperature in the range of from 250° C. to 380° C., at a pressure in the range of 5400 kPa to 20,500 kPa, using (i) a treat gas containing molecular hydrogen and (ii) at least one catalyst containing one or more of Co, Ni, or Mo. The loss of efficiency has been attributed to the presence of TH in the SCT, which leads to the formation of undesirable deposits (e.g., coke deposits) on the hydroprocessing catalyst and the reactor internals. As the amount of these deposits increases, the yield of the desired upgraded pyrolysis tar (upgraded SCT) decreases and the yield of undesirable byproducts increases. The hydroprocessing reactor pressure drop also increases, often to a point where the reactor is inoperable.

It is conventional to lessen deposit formation by hydroprocessing the SCT in the presence of a utility fluid, e.g., a solvent having significant aromatics content. The upgraded SCT product generally has a decreased viscosity, decreased atmospheric boiling point range, and increased hydrogen content over that of the SCT feed, resulting in improved compatibility with fuel oil blend-stocks. Additionally, hydroprocessing the SCT in the presence of utility fluid produces fewer undesirable byproducts and the rate of increase in reactor pressure drop is lessened. Conventional processes for SCT hydroprocessing, disclosed in U.S. Pat. Nos. 2,382,260 and 5,158,668 and in International Patent Application Publication No. WO 2013/033590 involves recycling a portion of the hydroprocessed tar for use as the utility fluid.

The feed to the hydroprocessing reactor can be a mixture of SCT and utility fluid. It is conventional to recycle a portion of the liquid phase components of the hydroprocessor effluent as utility fluid. When doing so, it has been found to be sometimes necessary to add a supplemental utility fluid (e.g., Steam Cracked Naphtha ("SCN")) to the feed to prevent deposits in the hydroprocessing reactor and/or SCT pre-heating equipment. This can be the case when the quality of the SCT in the feed changes sufficiently to result in an increase in the viscosity and/or final boiling point of the liquid phase components of the hydroprocessed effluent.

Since the supplemental utility fluid is itself a valuable product of the steam cracking process, there is a need for a SCT hydroprocessing process having a decreased need for supplemental utility fluid. It is particularly desired for such processes to produce an upgraded SCT having the desired properties at high yield over a broad SCT compositional range and/or a range of hydroprocessing temperature and pressure.

SUMMARY

Certain aspects of the invention are based on the discovery of a utility fluid having the following desirable features: 1) high solvency as measured by solubility blending number ("$S_{BN}$"), 2) minimal or inert reactivity when hydroprocessed (thereby reducing product variability and increasing catalyst life); and 3) easy recoverability from the hydroprocessed product and easy recyclability (thereby mitigating the cost of providing supplemental utility fluid). Using the specified utility fluid for pyrolysis tar hydroprocessing has been surprisingly found to lessen the rate of increase in hydroprocessing reactor pressure drop.

In certain aspects, the specified utility fluid comprises ≥10.0 wt % aromatic and non-aromatic ring compounds and each of the following: (a) ≥1.0 wt % of 1.0 ring class compounds which are compounds comprising only one moiety selected from the group consisting of (i) one aromatic ring and (ii) two non-aromatic rings; (b) ≥5.0 wt % of 1.5 ring class compounds which are compounds comprising only one moiety selected from the group consisting of (i) one aromatic ring and one non-aromatic ring and (ii) three non-aromatic rings; (c) ≥5.0 wt % of 2.0 ring class compounds which are compounds comprising only one moiety selected from the group consisting of (i) two aromatic rings, (ii) one aromatic ring and two non-aromatic rings and (iii) four non-aromatic rings; and (d) ≤0.1 wt % of 5.0 ring class compounds which are compounds comprising only one moiety selected from the group consisting of (i) five aromatic rings, (ii) four aromatic rings and two non-aromatic rings, (iii) three aromatic rings and four non-aromatic rings, (iv) two aromatic rings and six non-aromatic rings, (v) one aromatic ring and eight non-aromatic rings and (vi) ten non-aromatic rings. In each case, the weight percents are based on the weight of the utility fluid.

The invention also relates to a pyrolysis tar hydroprocessing process. A primer fluid may be provided to start the hydroprocessing process. Once the pyrolysis tar hydroprocessing process is producing sufficient hydroprocessed product, a portion of the hydroprocessed product is separated and substituted for at least part of the primer fluid. For example, a mid-cut portion of the hydroprocessed product may be substituted for at least a portion of the primer fluid.

Accordingly, other aspects of the invention relate to a pyrolysis tar hydroprocessing process which comprises at least seven steps. The first step is providing a first mixture comprising ≥10.0 wt % hydrocarbon. The second step is pyrolysing the first mixture to produce a second mixture comprising ≥1.0 wt % of $C_2$ unsaturates. The third step is separating a tar stream from the second mixture, wherein the tar stream includes ≥90 wt % of the second mixture's molecules having an atmospheric boiling point of ≥290° C. The fourth step is providing a primer fluid, the primer fluid comprising aromatic and non-aromatic ring compounds, and having an ASTM D86 10% distillation point ≥60.0° C. and a 90% distillation point ≤350.0° C. The fifth step is hydroprocessing the tar stream by contacting the tar stream with at least one hydroprocessing catalyst under catalytic hydroprocessing conditions in the presence of molecular hydrogen and in the presence of primer fluid to convert at least a portion of the tar stream to a hydroprocessed product. The sixth step is separating from the hydroprocessed product (i) an overhead comprising from 0 to 20 wt % of the hydroprocessed product, (ii) a mid-cut comprising from 20 to 70 wt % of the hydroprocessed product, and (iii) a bottoms comprising from 20 to 70 wt % of the hydroprocessed product. In the seventh and final step, at least a portion of the mid-cut is recycled and substituted for at least a portion of the primer fluid utilized in hydroprocessing the tar stream.

The invention also relates to a pyrolysis tar hydroprocessing to produce the specified utility fluid by hydroprocessing a primer fluid, and then using hydroprocessed primer fluid for pyrolysis tar hydroprocessing. The hydroprocessing of the primer fluid can be carried out in the same vessel as is later used for pyrolysis tar hydroprocessing using the same hydroprocessing catalyst. Hydroprocessing the primer fluid before tar hydroprocessing removes undesirable reactive components from the primer fluid. One advantage of this method is that a readily available and economical primer fluid having high solvency but also containing reactive components, e.g., steam cracked gas oil, may be hydroprocessed to remove or reduce the reactive components and produce a hydroprocessed primer fluid having the composition of the specified utility fluid.

Accordingly, further aspects of the invention relate to a pyrolysis tar hydroprocessing process comprising at least six steps. The first step is providing a primer fluid, the primer fluid comprising (i) aromatic and non-aromatic ring compounds and (ii) vinyl aromatics, and having an ASTM D86 10% distillation point ≥60.0° C. and a 90% distillation point ≤350.0° C. The second step is hydroprocessing the primer fluid to produce a hydroprocessed primer fluid by contacting the primer fluid with at least one hydroprocessing catalyst under catalytic hydroprocessing conditions in the presence of molecular hydrogen. The third step is providing a first mixture comprising ≥10.0 wt % hydrocarbon based on the weight of the first mixture. The fourth step is pyrolysing the first mixture to produce a second mixture comprising ≥1.0 wt % of $C_2$ unsaturates, based on the weight of the second mixture. The fifth step is separating a tar stream from the second mixture, wherein the tar stream includes ≥90 wt % of the second mixture's molecules having an atmospheric boiling point of ≥290° C. The sixth step is hydroprocessing the tar stream by contacting the tar stream with the same hydroprocessing catalyst under catalytic hydroprocessing conditions in the presence of molecular hydrogen and a utility fluid to convert at least a portion of the tar stream to a hydroprocessed product, wherein the utility fluid comprises ≥10.0 wt % of the hydroprocessed primer fluid.

These and other features, aspects, and advantages of the present invention will become better understood from the following description, appended claims, and accompanying drawings.

BRIEF DESCRIPTION OF THE DRAWINGS

The drawings are for illustrative purposes only and are not intended to limit the scope of the present invention.

DETAILED DESCRIPTION

Definitions

Figure 1:
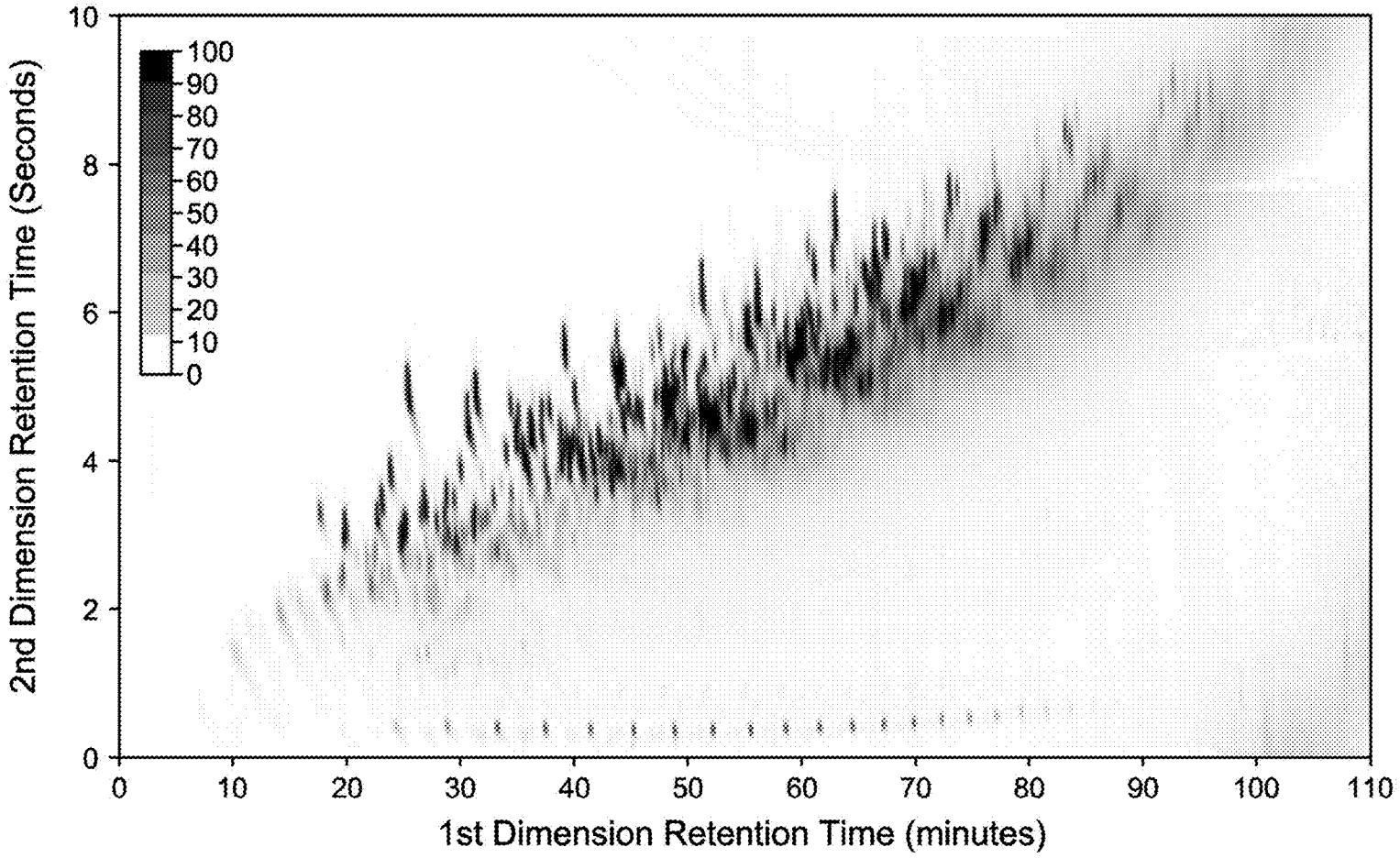
FIG. 1 shows a two dimensional gas chromatography ("2D GC") analysis of a hydroprocessed product sample obtained by hydroprocessing SCT in the presence of the specified utility fluid under the specified hydroprocessing conditions.

In this description and appended claims, the term "moiety" means any portion of a molecular structure.

"SCT" means (a) a mixture of hydrocarbons having one or more aromatic components and optionally (b) non-aromatic and/or non-hydrocarbon molecules, the mixture being derived from hydrocarbon pyrolysis and having a 90% Total Boiling Point ≥about 550° F. (290° C.) (e.g., ≥90.0 wt % of the SCT molecules have an atmospheric boiling point ≥550° F. (290° C.)). SCT can comprise >50.0 wt % (e.g., >75.0 wt %, such as >90.0 wt %), based on the weight of the SCT, of hydrocarbon molecules (including mixtures and aggregates thereof) having (i) one or more aromatic components and (ii) a molecular weight >about $C_{15}$. SCT generally has a metals content, $\leq 1.0\times10^3$ ppmw, based on the weight of the SCT (e.g., an amount of metals that is far less than that found in crude oil (or crude oil components) of the same average viscosity).

"Tar Heavies" means a product of hydrocarbon pyrolysis, the TH having an atmospheric boiling point >565° C. and comprising >5.0 wt % of molecules having a plurality of aromatic cores based on the weight of the product. The TH are typically solid at 25.0° C. and generally include the fraction of SCT that is not soluble in a 5:1 (vol.:vol.) ratio of n-pentane:SCT at 25.0° C. TH generally includes asphaltenes and other high molecular weight molecules.

Description

The invention is based in part on the discovery of a utility fluid that is useful for hydroprocessing pyrolysis tar. Generally, the utility fluid comprises to a large extent a mixture of multi-ring compounds. The rings can be aromatic or non-aromatic and can contain a variety of substituents and/or heteroatoms. For example, the utility fluid can contain ≥40.0 wt %, ≥45.0 wt %, ≥50.0 wt %, ≥55.0 wt %, or ≥60.0 wt %, based on the weight of the utility fluid, of aromatic and non-aromatic ring compounds.

The utility fluid can have an ASTM D86 10% distillation point ≥60° C. and a 90% distillation point ≤350° C. Optionally, the utility fluid (which can be a solvent or mixture of solvents) has an ASTM D86 10% distillation point ≥120° C., e.g., ≥140° C., such as ≥150° C. and/or an ASTM D86 90% distillation point ≤300° C.

In one or more embodiments, the utility fluid (i) has a critical temperature in the range of 285° C. to 400° C., and (ii) comprises aromatics, including alkyl-functionalized derivatives thereof. For example, the specified utility fluid can comprise ≥90.0 wt % of a single-ring aromatic, including those having one or more hydrocarbon substituents, such as from 1 to 3 or 1 to 2 hydrocarbon substituents. Such substituents can be any hydrocarbon group that is consistent with the overall solvent distillation characteristics. Examples of such hydrocarbon groups include, but are not limited to, those selected from the group consisting of $C_1$-$C_6$ alkyl, wherein the hydrocarbon groups can be branched or linear and the hydrocarbon groups can be the same or different. Optionally, the specified utility fluid comprises ≥90.0 wt % based on the weight of the utility fluid of one or more of benzene, ethylbenzene, trimethylbenzene, xylenes, toluene, naphthalenes, alkylnaphthalenes (e.g., methylnaphtalenes), tetralins, or alkyltetralins (e.g., methyltetralins).

It is generally desirable for the utility fluid to be substantially free of molecules having terminal unsaturates, for example, vinyl aromatics, particularly in embodiments utilizing a hydroprocessing catalyst having a tendency for coke formation in the presence of such molecules. The term "substantially free" in this context means that the utility fluid comprises ≤10.0 wt % (e.g., ≤5.0 wt % or ≤1.0 wt %) vinyl aromatics, based on the weight of the utility fluid.

Generally, the utility fluid contains sufficient amount of molecules having one or more aromatic cores to effectively increase run length of the pyrolysis tar hydroprocessing process. For example, the utility fluid can comprise ≥50.0 wt % of molecules having at least one aromatic core (e.g., ≥60.0 wt %, such as ≥70 wt %) based on the total weight of the utility fluid. In an embodiment, the utility fluid comprises (i) ≥60.0 wt % of molecules having at least one aromatic core and (ii) ≤1.0 wt % of vinyl aromatics, the weight percents being based on the weight of the utility fluid.

The utility fluid has high solvency as measured by solubility blending number ("$S_{BN}$"). The utility fluid can have $S_{BN}$≥90. Preferably, the utility fluid has $S_{BN}$≥100, e.g., ≥110.

The utility fluid will now be described in terms of moieties falling into distinct ring classes. Preferred, among each ring class described, are those moieties comprising at least one aromatic core.

In this description and appended claims, a "0.5 ring class compound" means a molecule having only one non-aromatic ring moiety and no aromatic ring moieties in the molecular structure.

The term "non-aromatic ring" means four or more carbon atoms joined in at least one ring structure wherein at least one of the four or more carbon atoms in the ring structure is not an aromatic carbon atom. Aromatic carbon atoms can be identified using, e.g., $^{13}C$ Nuclear magnetic resonance, for example. Non-aromatic rings having atoms attached to the ring (e.g., one or more heteroatoms, one or more carbon atoms, etc.), but which are not part of the ring structure, are within the scope of the term "non-aromatic ring".

Examples of non-aromatic rings include:

(i) a pentacyclic ring—five carbon member ring such as

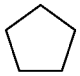

cyclopentane (ii) a hexcyclic ring—six carbon member ring such as

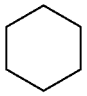

cyclohexane

The non-aromatic ring can be statured as exemplified above or partially unsaturated for example, cyclopentene, cyclopenatadiene, cyclohexene and cyclohexadiene.

Non aromatic rings (which in SCT are primarily six and five member non-aromatic rings), can contain one or more heteroatoms such as sulfur (S), nitrogen (N) and oxygen (O). Non limiting examples of non-aromatic rings with heteroatoms includes the following:

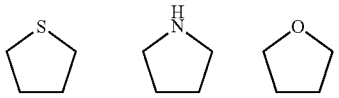

tetrahydrothiophene pyrrolidine tetrahydrofuran

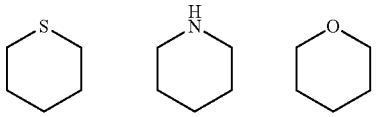

tetrahydro-2H-thiopyran piperidine tetrahydro-2H-pyran.

The non-aromatic rings with hetero atoms can be saturated as exemplified above or partially unsaturated.

In this description and appended claims, a "1.0 ring class compound" means a molecule containing only one of the following ring moieties but no other ring moieties:

(i) one aromatic ring 1•(1.0 ring) in the molecular structure, or (ii) two non-aromatic rings 2•(0.5 ring) in the molecular structure.

The term "aromatic ring" means five or six atoms joined in a ring structure wherein (i) at least four of the atoms joined in the ring structure are carbon atoms and (ii) all of the carbon atoms joined in the ring structure are aromatic carbon atoms. Aromatic rings having atoms attached to the ring (e.g., one or more heteroatoms, one or more carbon atoms, etc.) but which are not part of the ring structure are within the scope of the term "aromatic ring".

Representative aromatic rings include, e.g:

(i) a benzene ring

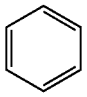

benzene (ii) a thiophene ring such as

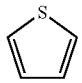

thiophene (iii) a pyrrole ring such as

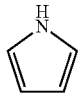

1H-pyrrole (iv) a furan ring such as

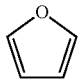

furan

When there is more than one ring in a molecular structure, the rings can be aromatic rings and/or non-aromatic rings. The ring to ring connection can be of two types: type (1) where at least one side of the ring is shared, and type (2) where the rings are connected with at least one bond. The type (1) structure is also known as a fused ring structure. The type (2) structure is also commonly known as a bridged ring structure.

A few non-limiting examples of the type (1) fused ring structure are as follows:

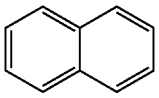

naphthalene

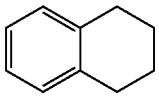

1,2,3,4-tetrahydronaphthalene

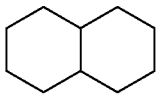

decahydronaphthalene

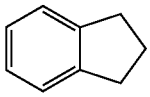

indane

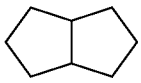

octahydropentalene.

A non-limiting example of the type (2) bridged ring structure is as follows:

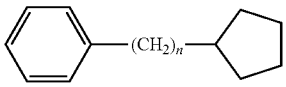

where n=0, 1, 2, or 3.

When there are two or more rings (aromatic rings and/or non-aromatic rings) in a molecular structure, the ring to ring connection may include all type (1) or type (2) connections or a mixture of both types (1) and (2).

The following define the compound classes for the multi-ring compounds for the purpose of this description and appended claims:

Compounds of the 1.0 ring class contain only one of the following ring moieties but no other ring moieties:

(i) one aromatic ring 1•(1.0 ring) in the molecular structure, or (ii) two non-aromatic rings 2•(0.5 ring) in the molecular structure.

Compounds of the 1.5 ring class contain only one of the following ring moieties, but no other ring moieties:

(i) one aromatic ring 1•(1.0 ring) and one non-aromatic ring 1•(0.5 ring) in the molecular structure or (ii) three non-aromatic rings 3 (0.5 ring) in the molecular structure.

Compounds of the 2.0 ring class contain only one of the following ring moieties, but no other ring moieties:

(i) two aromatic rings 2•(1.0 ring) or (ii) one aromatic ring 1•(1.0 ring) and two non-aromatic rings 2•(0.5 ring) in the molecular structure, or (iii) four non-aromatic rings 4•(0.5 ring) in the molecular structure.

Compounds of the 2.5 ring class contain only one of the following ring moieties but no other ring moieties:

(i) two aromatic rings 2•(1.0 ring) and one non-aromatic rings 1•(0.5 ring) in the molecular structure or (ii) one aromatic ring 1•(1.0 ring) and three non-aromatic rings 3•(0.5 ring) in the molecular structure or (iii) five non-aromatic rings 5•(0.5 ring) in the molecular structure.

Likewise compounds of the 3.0, 3.5, 4.0, 4.5, 5.0, etc. molecular classes contain a combination of non-aromatic rings counted as 0.5 ring, and aromatic ring counted as 1.0 ring, such that the total is 3.0, 3.5, 4.0, 4.5, 5.0, 5.5, 6.0, 6.5, 7.0, etc. respectively.

For example, compounds of the 5.0 ring class contain only one of the following ring moieties but no other ring moieties:

(i) five aromatic rings 5•(1.0 ring) or (ii) four aromatic rings 4•(1.0 ring) and two non-aromatic rings 2•(0.5 ring) in the molecular structure or (iii) three aromatic rings 3•(1.0 ring) and four non-aromatic rings 4•(0.5 ring) in the molecular structure or (iv) two aromatic rings 2•(1.0 ring) and six non-aromatic rings 6•(0.5 ring) in the molecular structure or (v) one aromatic ring 1•(1.0 ring) and eight non-aromatic rings 8•(0.5 ring) in the molecular structure or (vi) ten non-aromatic rings 10•(0.5 ring) in the molecular structure.

All of these multi-ring classes include ring compounds having hydrogen, alkyl, or alkenyl groups bound thereto, e.g., one or more of H, $CH_2$, $C_2H_4$ through $C_nH_{2n}$, $CH_3$, $C_2H_5$ through $C_nH_{2n+1}$. Generally, $_n$ is in the range of from 1 to 6, e.g., from 1 to 5.

The utility fluid may comprise 0.5, 1.0, 1.5, 2.0, 2.5, 3.0, 3.5, 4.0, 4.5 ring class compounds. The utility fluid can further comprise ≤0.1 wt %, e.g., ≤0.05 wt %, such as ≤0.01 wt % of 5.0 ring class compounds, based on the weight of the utility fluid. Preferably, the utility fluid comprises ≤0.1 wt %, e.g., ≤0.05 wt %, such as ≤0.01 wt % total of 5.5, 6.0, 6.5, and 7.0 ring class compounds, based on the weight of the utility fluid. The utility fluid may comprise from 0.5 to 7.0 ring class compounds. Preferably, the utility fluid comprises from 0.5 to 5.0, more preferably 1.0 to 3.0 ring class compounds.

In certain aspects, the utility can comprise, consist essentially of, or consist of ≥1.0 wt % of 1.0 ring class compounds, ≥5.0 wt % of 1.5 ring class compounds, and ≥5.0 wt % of 2.0 ring class compounds, where the weight percents are based on the weight of the utility fluid. Preferably, the utility fluid comprises ≥5.0 wt % of 1.0 ring class compounds, ≥15.0 wt % of 1.5 ring class compounds, and ≥10.0 wt % of 2.0 ring class compounds, where the weight percents are based on the weight of the utility fluid. More preferably, the utility fluid comprises ≥5.0 wt % of 1.0 ring class compounds, ≥35.0 wt % of 1.5 ring class compounds, and ≥20.0 wt % of 2.0 ring class compounds. Optionally, the utility fluid comprises one or more of (i) ≤20 wt % of 1.0 ring class compounds, (ii) ≤1.0 wt % of 4.0 ring class compounds, and (iii) ≤1.0 wt % of 3.0 ring class compounds, where the weight percents are based on the weight of the utility fluid.

Conventional methods can be utilized to determine the types and amounts of compounds in the multi-ring classes defined above in, e.g., the utility fluid, though the invention is not limited thereto. For example, it has been found that two-dimensional gas chromatography ("2D GC") is a convenient methodology for performing a quantitative analysis of samples of tar, hydroprocessed product, and other streams and mixtures as might result from operating certain embodiments of the invention. The use of two-dimensional chromatography as an analytic tool for identifying the types and amounts of compounds of the specified molecular classes will now be described in more detail. The invention is not limited to this method, and this description is not meant to foreclose other methods for identifying molecular types and amounts within the broader scope of the invention, e.g., other gas chromatography/mass spectrometry (GC/MS) techniques.

Two-Dimensional Gas Chromatography

In (2D GC), a sample is subjected to two sequential chromatographic separations. The first separation is a partial separation by a first or primary separation column. The partially separated components are then injected into a second or secondary column where they undergo further separation. The two columns usually have different selectivities to achieve the desired degree of separation. An example of 2D GC may be found in U.S. Pat. No. 5,169,039, which is incorporated by reference herein in its entirety.

A sample is injected into an inlet device connected to the inlet of the first column to produce a first dimension chromatogram. The sample injection method used is not critical, and the use of conventional sample injection devices such as a syringe is suitable, though the invention is not limited thereto. In certain embodiments, the inlet device holds a single sample, although those that hold multiple samples for injection into the first column are within the scope of the invention. The column generally contains a stationary phase which is usually the column coating material.

The first column is generally coated with a non-polar material. When column coating material is methyl silicon polymer, the polarity can be measured by the percentage of methyl groups substituted by the phenyl group. The polarity of a particular coating material can be measured on a % of phenyl group substitution scale from 0 to 100 with zero being non-polar and 80 (80% phenyl substitution) being polar. These methyl silicon polymers are considered non-polar and have polarity values in the range 0 to 20. Phenyl-substituted methyl silicon polymers are considered semi-polar and have polar values of 21 to 50. Phenyl-substituted methyl silicon polymer coating materials are considered polar when greater than 51% phenyl-substituted methyl groups are included in the polymers. Other polar coating polymers, such as carbowaxes, are also used in chromatographic applications. Carbowaxes are polyethylene glycols of higher molecular weight. A series of carborane silicon polymers sold under the trade name Dexsil have also been designed especially for high temperature applications.

The first column, coated with a non-polar material, provides a first separation of the sample. The first separation, also known as the first dimension, generates a series of bands over a specified time period. This first dimension chromatogram is similar to a conventional one-dimensional chromatogram. The bands represent individual components or groups of components of the sample injected, and are generally fully separated or partially overlapped with adjacent bands.

When the complex mixture is separated by the first dimension column, the complex mixture includes many co-elutions (components not fully separated by the first dimension column) The bands of separated materials from the first dimension are then completely sent to the second column to undergo further separation, especially on the co-eluted components. The materials are further separated in the second dimension. The second dimension is obtained from a second column coated with a semi-polar or polar material, preferably a semi-polar coating material.

To facilitate acquisition of the detector signal, a modulator is utilized to manage the flow between the end of the first column and the beginning of the second column. Suitable modulators include thermal modulators utilizing trap/release mechanism, such as those in which cold nitrogen gas is used to trap separated sample from the first dimension followed by a periodic pulse of hot nitrogen to release trapped sample to the second dimension. Each pulse is analogous to a sample injection into the second dimension.

The role of the modulator is to (1) collect the continuous eluent flow out from the end of the first column with a fixed period of time (modulated period) and (2) inject to the beginning of the second column by release collected eluent at once at the end of the modulated period. The function of the modulator is to (1) define the beginning time of a specific second dimensional column separation and (2) define the length of the second dimensional separation (modulation period).

The separated bands from the second dimension are coupled with the bands from the first dimension to form a comprehensive 2D chromatogram. The bands are placed in a retention plane wherein the first dimension retention times and the second dimension retention times form the axes of the 2D chromatogram.

For example, a conventional GC experiment takes 110 minutes to separate a mixture (a chromatogram with 110 minute retention time, x-axis). When the same experiment is performed under 2D GC conditions with a 10 second modulation period, it will become 660 chromatograms (60 second×110 minute divided 10 second) where each 10 second chromatogram (y-axis) lines up one-by-one along the retention time axis (x-axis). In 2D GC, the x-axis is the first dimension retention time (the same as in conventional GC), the y-axis is the second dimensional retention time, and the peak intensity would project out in the third dimension z-axis. In order to express this 3D picture in a two dimensional diagram, the intensity can be converted based on a pre-defined gray scale (from black to white with different shades of grey) or a pre-defined color table to express their relative peak intensity.

FIG. 1 shows a 2D GC of a hydroprocessed product sample obtained by hydroprocessing SCT in the presence of the specified utility fluid under the specified hydroprocessing conditions.

Figure 2:
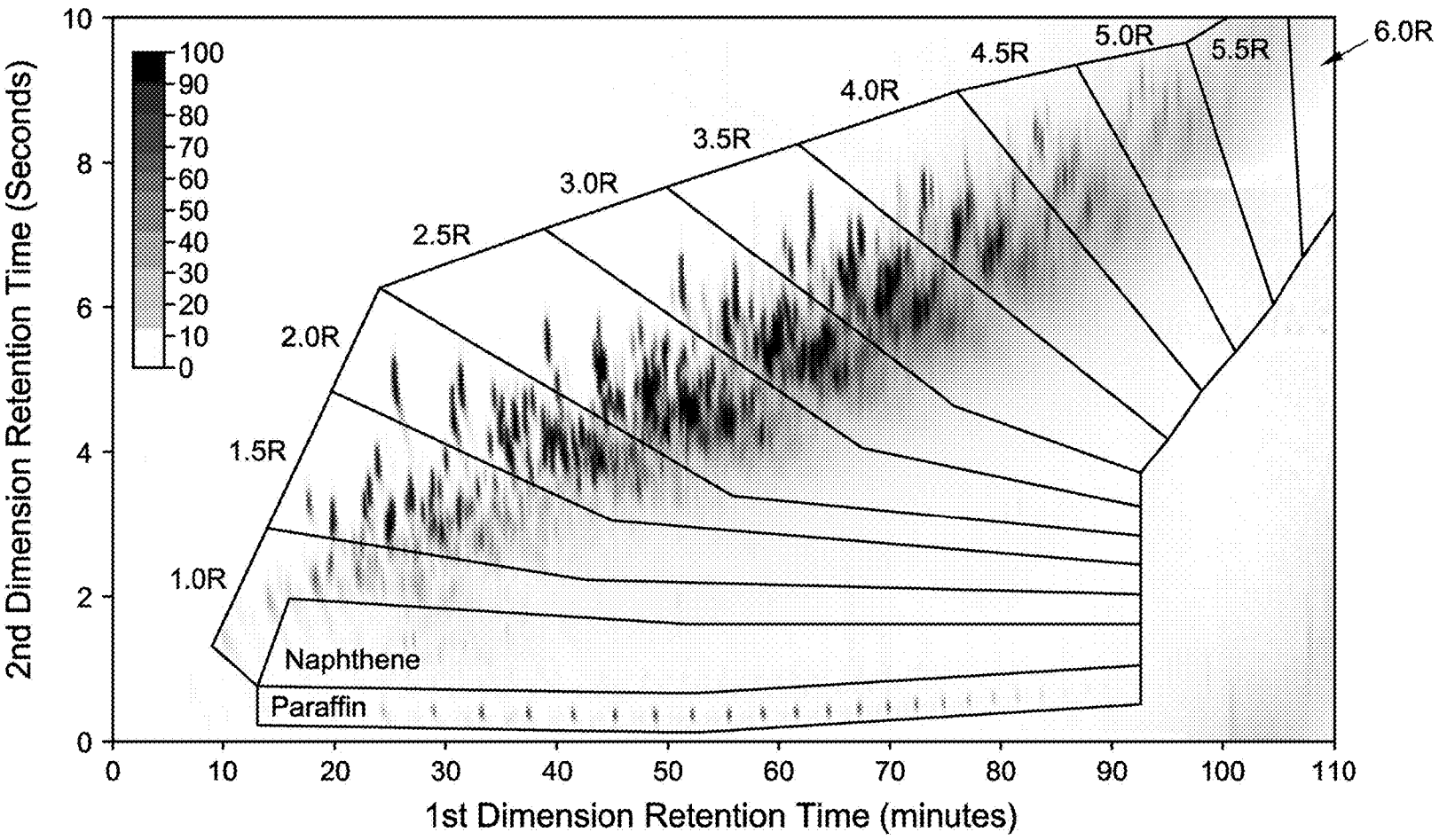
FIG. 2 illustrates a quantitative analysis of 2D GC data.

The 2D GC (GC×GC) system utilizes an Agilent 6890 gas chromatograph (Agilent Technology, Wilmington, Del.) configured with inlet, columns, and detectors. A split/splitless inlet system with an eight-vial tray autosampler was used. The two-dimensional capillary column system utilizes a non-polar first column (BPX-5, 30 meter, 0.25 mm I.D., 1.0 μm film), and a polar (BPX-50, 2 meter, 0.25 mm I.D., 0.25 μm film), second column. Both capillary columns are obtained from SGE Inc. Austin, Tex. A looped single jet thermal modulation assembly (ZOEX Corp. Lincoln, Nebr.) which is a liquid nitrogen cooled "trap-release" dual jet thermal modulator is installed between these two columns. A flame ionization detector (FID) is used for the signal detection. A 1.0 microliter sample is injected with 25:1 split at 300° C. from Inlet. Carrier gas flow is substantially constant at 2.0 mL/min. The oven is programmed from 60° C. with 0 minute hold and 3.0° C. per minute increment to 390° C. with 0 minute hold. The total GC run time is 110 minutes. The modulation period is 10 seconds. The sampling rate for the detector is 100 Hz. FIGS. 1 and 2 show a conventional quantitative analysis of the 2D GC data, utilizing a commercial program ("Transform" (Research Systems Inc. Boulder, Colo.) and PhotoShop™ program (Adobe System Inc. San Jose, Calif.) to generate the images.

Pyrolysis Tar

Certain aspects of the invention relate to hydroprocessing a pyrolysis tar in the presence of the specified utility fluid. Pyrolysis tar can be produced by exposing a hydrocarbon-containing feed to pyrolysis conditions in order to produce a pyrolysis effluent, the pyrolysis effluent being a mixture comprising unreacted feed, unsaturated hydrocarbon produced from the feed during the pyrolysis, and pyrolysis tar. For example, when a feed comprising ≥10.0 wt % hydrocarbon, based on the weight of the feed, is subjected to pyrolysis, the pyrolysis effluent generally contains pyrolysis tar and ≥1.0 wt % of $C_2$ unsaturates, based on the weight of the pyrolysis effluent. The pyrolysis tar generally comprises ≥90 wt % of the pyrolysis effluent's molecules having an atmospheric boiling point of ≥290° C. Besides hydrocarbon, the feed to pyrolysis optionally further comprise diluent, e.g., one or more of nitrogen, water, etc., e.g., ≥1.0 wt % diluent based on the weight of the first mixture, such as ≥25.0 wt %. When the diluent includes an appreciable amount of steam, the pyrolysis is referred to as steam cracking. When steam cracking is used, the resulting pyrolysis tar is SCT.

Aspects of the invention which include producing SCT by steam cracking will now be described in more detail. The invention is not limited to these aspects, and this description is not meant to foreclose other aspects within the broader scope of the invention, such as those which do not include steam cracking.

Obtaining Pyrolysis Tar by Steam Cracking

Conventional steam cracking utilizes a pyrolysis furnace which has two main sections: a convection section and a radiant section. The feedstock ("first mixture") typically enters the convection section of the furnace where the first mixture's hydrocarbon is heated and vaporized by indirect contact with hot flue gas from the radiant section and by direct contact with the first mixture's steam. The vaporized first mixture is then introduced into the radiant section where ≥50% (weight basis) of the cracking takes place. A pyrolysis effluent ("second mixture") is conducted away from the pyrolysis furnace, the second mixture comprising products resulting from the pyrolysis of the first mixture and any unreacted components of the first mixture. At least one separation stage is generally located downstream of the pyrolysis furnace, the separation stage being utilized for separating from the second mixture one or more of light olefin, SCN, SCGO, SCT, water, unreacted hydrocarbon components of the first mixture, etc. The separation stage can comprise, e.g., a primary fractionator. Generally, a cooling stage is located between the pyrolysis furnace and the separation stage. Conventional cooling means can be utilized by the cooling stage, e.g., one or more direct quench and/or or indirect heat exchange, but the invention is not limited thereto.

In certain aspects, SCT is obtained as a product of pyrolysis conducted in one or more pyrolysis furnaces, e.g., one or more steam cracking furnaces. Besides SCT, such furnaces generally produce (i) vapor-phase products such as one or more of acetylene, ethylene, propylene, butenes, and (ii) liquid-phase products comprising, e.g., one or more of C5+ molecules, and mixtures thereof. The liquid-phase products are generally conducted together to a separation stage, e.g., a primary fractionator, for separation of one or more of (a) overheads comprising steam-cracked naphtha ("SCN", e.g., $C_5$-$C_{10}$ species) and steam cracked gas oil ("SCGO"), the SCGO comprising ≥90.0 wt % based on the weight of the SCGO of molecules (e.g., $C_{10}$-$C_{17}$ species) having an atmospheric boiling point in the range of about 400° F. to 550° F. (200° C. to 290° C.), and (b) a bottoms stream comprising ≥90.0 wt % SCT, based on the weight of the bottoms stream.

The first mixture comprises hydrocarbon and steam. In certain aspects, the first mixture comprises ≥10.0 wt % hydrocarbon, based on the weight of the first mixture, e.g., ≥25.0 wt %, ≥50.0 wt %, such as ≥0.65 wt %. Although the first mixture's hydrocarbon can comprise one or more of light hydrocarbons such as methane, ethane, propane, butane etc., it can be particularly advantageous to utilize the invention in connection with a first mixture comprising a significant amount of higher molecular weight hydrocarbons because the pyrolysis of these molecules generally results in more SCT than does the pyrolysis of lower molecular weight hydrocarbons. As an example, the first mixture can comprise ≥1.0 wt % or ≥25.0 wt % based on the weight of the first mixture of hydrocarbons that are in the liquid phase at ambient temperature and atmospheric pressure. More than one steam cracking furnace can be used, and these can be operated (i) in parallel, where a portion of the first mixture is transferred to each of a plurality of furnaces, (ii) in series, where at least a second furnace is located downstream of a first furnace, the second furnace being utilized for cracking unreacted first mixture components in the first furnace's pyrolysis effluent, and (iii) a combination of (i) and (ii).

In certain aspects, the first mixture's hydrocarbon comprises ≥5 wt % of non-volatile components, based on the weight of the hydrocarbon portion, e.g., ≥30 wt %, such as ≥40 wt %, or in the range of 5 wt % to 50 wt %. Non-volatile components are the fraction of the hydrocarbon feed with a nominal boiling point above 1100° F. (590° C.) as measured by ASTM D-6352-98 or D-2887, extended by extrapolation for materials having a boiling point at atmospheric pressure ("atmospheric boiling point) ≥700° C. (1292° F.). Non-volatile components can include coke precursors, which are moderately heavy and/or reactive molecules, such as multi-ring aromatic compounds, which can condense from the vapor phase and then form coke under the operating conditions encountered in the present process of the invention. Examples of suitable hydrocarbons include, one or more of steam cracked gas oil and residues, gas oils, heating oil, jet fuel, diesel, kerosene, gasoline, coker naphtha, steam cracked naphtha, catalytically cracked naphtha, hydrocrackate, reformate, raffinate reformate, Fischer-Tropsch liquids, Fischer-Tropsch gases, natural gasoline, distillate, virgin naphtha, crude oil, atmospheric pipestill bottoms, vacuum pipestill streams including bottoms, wide boiling range naphtha to gas oil condensates, heavy non-virgin hydrocarbon streams from refineries, vacuum gas oils, heavy gas oil, naphtha contaminated with crude, atmospheric residue, heavy residue, $C_4$/residue admixture, naphtha/residue admixture, gas oil/residue admixture, and crude oil. The first mixture's hydrocarbon can have a nominal final boiling point of at least about 600° F. (315° C.), generally greater than about 950° F. (510° C.), typically greater than about 1100° F. (590° C.), for example greater than about 1400° F. (760° C.). Nominal final boiling point means the temperature at which 99.5 weight percent of a particular sample has reached its boiling point.

In certain aspects, the first mixture's hydrocarbon comprises ≥10.0 wt %, e.g., ≥50.0 wt %, such as ≥90.0 wt % (based on the weight of the hydrocarbon) of one or more of naphtha, gas oil, vacuum gas oil, waxy residues, atmospheric residues, residue admixtures, or crude oil; including those comprising ≥about 0.1 wt % asphaltenes. When the hydrocarbon includes crude oil and/or one or more fractions thereof, the crude oil is optionally desalted prior to being included in the first mixture. An example of a crude oil fraction utilized in the first mixture is produced by separating atmospheric pipestill ("APS") bottoms from a crude oil and followed by vacuum pipestill ("VPS") treatment of the APS bottoms.

Suitable crude oils include, e.g., high-sulfur virgin crude oils, such as those rich in polycyclic aromatics. For example, the first mixture's hydrocarbon can include ≥90.0 wt % of one or more crude oils and/or one or more crude oil fractions, such as those obtained from an atmospheric APS and/or VPS; waxy residues; atmospheric residues; naphthas contaminated with crude; various residue admixtures; and SCT.

Optionally, the first mixture's hydrocarbon comprises sulfur, e.g., ≥0.1 wt % sulfur based on the weight of the first mixture's hydrocarbon, e.g., ≥1.0 wt %, such as in the range of about 1.0 wt % to about 5.0 wt %. Optionally, at least a portion of the first mixture's sulfur-containing molecules, e.g., ≥10.0 wt % of the first mixture's sulfur-containing molecules, contain at least one aromatic ring ("aromatic sulfur"). When (i) the first mixture's hydrocarbon is a crude oil or crude oil fraction comprising ≥0.1 wt % of aromatic sulfur and (ii) the pyrolysis is steam cracking, then the SCT contains a significant amount of sulfur derived from the first mixture's aromatic sulfur. For example, the SCT sulfur content can be about 3 to 4 times higher in the SCT than in the first mixture's hydrocarbon component, on a weight basis.

It has been found that including sulfur and/or sulfur-containing molecules in the first mixture lessens the amount of olefinic unsaturation (and the total amount of olefin) present in the SCT. For example, when the first mixture's hydrocarbon comprises sulfur, e.g., ≥0.1 wt % sulfur based on the weight of the first mixture's hydrocarbon, e.g., ≥1.0 wt %, such as in the range of about 1.0 wt % to about 5.0 wt %, then the amount of olefin contained in the SCT is ≤10.0 wt %, e.g., ≤5.0 wt %, such as ≤2.0 wt %, based on the weight of the SCT. More particularly, the amount of (i) vinyl aromatics in the SCT and/or (ii) aggregates in the SCT which incorporate vinyl aromatics is ≤5.0 wt %, e.g., ≤3 wt %, such as ≤2.0 wt %. While not wishing to be bound by any theory or model, it is believed that the amount of olefin in the SCT is lessened because the presence of feed sulfur leads to an increase in amount of sulfur-containing hydrocarbon molecules in the second mixture. Such sulfur-containing molecules can include, for example, one or more of mercaptans; thiophenols; thioethers, such as heterocyclic thioethers (e.g., dibenzosulfide; thiophenes, such as benzothiophene and dibenzothiophene, etc. The formation of these sulfur-containing hydrocarbon molecules is believed to lessen the amount of amount of relatively high molecular weight olefinic molecules (e.g., $C_{6+}$ olefin) produced during and after the pyrolysis, which results in fewer vinyl aromatic molecules available for inclusion in SCT, e.g., among the SCT's, TH aggregates. In other words, when the feedstock includes sulfur, the pyrolysis favors the formation in the SCT of sulfur-containing hydrocarbon, such as $C_{6+}$ mercaptan, over $C_{6+}$ olefins such as vinyl aromatics.

In certain aspects, the first mixture comprises steam in an amount in the range of from 10.0 wt % to 90.0 wt %, based on the weight of the first mixture, with the remainder of the first mixture comprising (or consisting essentially of, or consisting of) the hydrocarbon. Such a first mixture can be produced by combining hydrocarbon with steam, e.g., at a ratio of 0.1 to 1.0 kg steam per kg hydrocarbon, or a ratio of 0.2 to 0.6 kg steam per kg hydrocarbon.

When the first mixture's diluent comprises steam, the pyrolysis can be carried out under conventional steam cracking conditions. Suitable steam cracking conditions include, e.g., exposing the first mixture to a temperature (measured at the radiant outlet) ≥400° C., e.g., in the range of 400° C. to 900° C., and a pressure ≥0.1 bar, for a cracking residence time period in the range of from about 0.01 second to 5.0 seconds. In certain aspects, the first mixture comprises hydrocarbon and diluent, wherein the first mixture's hydrocarbon comprises ≥50.0 wt % based on the weight of the first mixture's hydrocarbon of one or more of one or more crude oils and/or one or more crude oil fractions, such as those obtained from an APS and/or VPS; waxy residues; atmospheric residues; naphthas contaminated with crude; various residue admixtures; and SCT; and the first mixture's diluent comprises, e.g., ≥95.0 wt % water based on the weight of the diluent, wherein the amount of diluent in the first mixture is in the range of from about 10.0 wt % to 90.0 wt %, based on the weight of the first mixture.

In these aspects, the steam cracking conditions generally include one or more of (i) a temperature in the range of 760° C. to 880° C.; (ii) a pressure in the range of from 1.0 to 5.0 bar (absolute), or (iii) a cracking residence time in the range of from 0.10 to 2.0 seconds.

A second mixture is conducted away from the pyrolysis furnace, the second mixture being derived from the first mixture by the pyrolysis. When utilizing the specified first mixture and pyrolysis conditions of any of the preceding aspects, the second mixture generally comprises ≥1.0 wt % of $C_2$ unsaturates and ≥0.1 wt % of TH, the weight percents being based on the weight of the second mixture. Optionally, the second mixture comprises ≥5.0 wt % of $C_2$ unsaturates and/or ≥0.5 wt % of TH, such as ≥1.0 wt % TH. Although the second mixture generally contains a mixture of the desired light olefins, SCN, SCGO, SCT, and unreacted components of the first mixture (e.g., water in the case of steam cracking, but also in some cases unreacted hydrocarbon), the relative amount of each of these generally depends on, e.g., the first mixture's composition, pyrolysis furnace configuration, process conditions during the pyrolysis, etc. The second mixture is generally conducted away for the pyrolysis section, e.g., for cooling and separation.

In certain aspects, the second mixture's TH comprise ≥10.0 wt % of TH aggregates having an average size in the range of 10.0 nm to 300.0 nm in at least one dimension and an average number of carbon atoms ≥50, the weight percent being based on the weight of Tar Heavies in the second mixture. Generally, the aggregates comprise ≥50.0 wt %, e.g., ≥80.0 wt %, such as ≥90.0 wt % of TH molecules having a C:H atomic ratio in the range of from 1.0 to 1.8, a molecular weight in the range of 250 to 5000, and a melting point in the range of 100° C. to 700° C.

Although it is not required, the invention is compatible with cooling the second mixture downstream of the pyrolysis furnace, e.g., the second mixture can be cooled using a system comprising transfer line heat exchangers. For example, the transfer line heat exchangers can cool the process stream to a temperature in the range of about 700° C. to 350° C., in order to efficiently generate super-high pressure steam which can be utilized by the process or conducted away. If desired, the second mixture can be subjected to direct quench at a point typically between the furnace outlet and the separation stage. The quench can be accomplished by contacting the second mixture with a liquid quench stream, in lieu of, or in addition to the treatment with transfer line exchangers. Where employed in conjunction with at least one transfer line exchanger, the quench liquid is preferably introduced at a point downstream of the transfer line exchanger(s). Suitable quench fluids include liquid quench oil, such as those obtained by a downstream quench oil knock-out drum, pyrolysis fuel oil and water, which can be obtained from conventional sources, e.g., condensed dilution steam.

A separation stage can be utilized downstream of the pyrolysis furnace and downstream of the transfer line exchanger and/or quench point for separating from the second mixture one or more of light olefin, SCN, SCGO, SCT, or water. Conventional separation equipment can be utilized in the separation stage, e.g., one or more flash drums, fractionators, water-quench towers, indirect condensers, etc., such as those described in U.S. Pat. No. 8,083,931. The separation stage can be utilized for separating an SCT-containing stream (a "tar stream") from the second mixture. The SCT generally comprises ≥90.0 wt % of TH based on the weight of the tar stream, e.g., ≥95.0 wt %, such as ≥99.0 wt %. The SCT generally comprises ≥10.0 wt % of the second mixture's TH based on the weight of the second mixture's TH. The tar stream can be obtained, e.g., from an SCGO stream and/or a bottoms stream of the steam cracker's primary fractionator, from flash-drum bottoms (e.g., the bottoms of one or more flash drums located downstream of the pyrolysis furnace and upstream of the primary fractionator), or a combination thereof. For example, the tar stream can be a mixture of primary fractionator bottoms and tar knock-out drum bottoms.

In certain aspects, the SCT comprises ≥50.0 wt % of the second mixture's TH based on the weight of the second mixture's TH. For example, the SCT can comprise ≥90.0 wt % of the second mixture's TH based on the weight of the second mixture's TH. The SCT can have, e.g., (i) a sulfur content in the range of 0.5 wt % to 7.0 wt %, based on the weight of the SCT; (ii) a TH content in the range of from 5.0 wt % to 40.0 wt %, based on the weight of the SCT; (iii) a density at 15° C. in the range of 1.01 g/cm3 to 1.15 g/cm3, e.g., in the range of 1.07 g/cm3 to 1.15 g/cm3; and (iv) a 50° C. viscosity in the range of 200 cSt to 1.0×107 cSt. The amount of olefin the SCT is generally ≤10.0 wt %, e.g., ≤5.0 wt %, such as ≤2.0 wt %, based on the weight of the SCT. More particularly, the amount of (i) vinyl aromatics in the SCT and/or (ii) aggregates in the SCT which incorporate vinyl aromatics is generally ≤5.0 wt %, e.g., ≤3 wt %, such as ≤2.0 wt %, based on the weight of the SCT.

Vapor-Liquid Separator

Optionally, the pyrolysis furnace has at least one vapor/liquid separation device (sometimes referred to as flash pot or flash drum) integrated therewith. The vapor-liquid separator is utilized for upgrading the first mixture before exposing it to pyrolysis conditions in the furnace's radiant section. It can be desirable to integrate a vapor-liquid separator with the pyrolysis furnace when the first mixture's hydrocarbon comprises ≥1.0 wt % of non-volatiles, e.g., ≥5.0 wt %, such as 5.0 wt % to 50.0 wt % of non-volatiles having a nominal boiling point ≥1400° F. (760° C.). The boiling point distribution and nominal boiling points of the first mixture's hydrocarbon are measured by Gas Chromatograph Distillation (GCD) according to the methods described in ASTM D-6352-98 or D-2887, extended by extrapolation for materials having a boiling point at atmospheric pressure ("atmospheric boiling point) ≥700° C. (1292° F.). It is particularly desirable to integrate a vapor/liquid separator with the pyrolysis furnace when the non-volatiles comprise asphaltenes, such as first mixture's hydrocarbon comprises ≥about 0.1 wt % asphaltenes based on the weight of the first mixture's hydrocarbon component, e.g., ≥about 5.0 wt %. Conventional vapor/liquid separation devices can be utilized to do this, though the invention is not limited thereto. Examples of such conventional vapor/liquid separation devices include those disclosed in U.S. Pat. Nos. 7,138,047; 7,090,765; 7,097,758; 7,820,035; 7,311,746; 7,220,887; 7,244,871; 7,247,765; 7,351,872; 7,297,833; 7,488,459; 7,312,371; 6,632,351; 7,578,929; and 7,235,705, which are incorporated by reference herein in their entirety. Generally, when using a vapor/liquid separation device, the composition of the vapor phase leaving the device is substantially the same as the composition of the vapor phase entering the device, and likewise the composition of the liquid phase leaving the device is substantially the same as the composition of the liquid phase entering the device, i.e., the separation in the vapor/liquid separation device includes (or even consists essentially of) a physical separation of the two phases entering the device.

In aspects which include integrating a vapor/liquid separation device with the pyrolysis furnace, at least a portion of the first mixture's hydrocarbon is provided to the inlet of a convection section of a pyrolysis unit, wherein hydrocarbon is heated so that at least a portion of the hydrocarbon is in the vapor phase. When a diluent (e.g., steam) is utilized, the first mixture's diluent is optionally (but preferably) added in this section and mixed with the hydrocarbon to produce the first mixture. The first mixture, at least a portion of which is in the vapor phase, is then flashed in at least one vapor/liquid separation device in order to separate and conduct away from the first mixture at least a portion of the first mixture's non-volatiles, e.g., high molecular-weight non-volatile molecules, such as asphaltenes. A bottoms fraction can be conducted away from the vapor-liquid separation device, the bottoms fraction comprising, e.g., ≥10.0% (on a wt. basis) of the first mixture's non-volatiles, such as ≥10.0% (on a wt. basis) of the first mixture's asphaltenes.

One of the advantages obtained when utilizing an integrated vapor-liquid separator is the lessening of the amount of $C_{6+}$ olefin in the SCT, particularly for when the first mixture's hydrocarbon has a relatively high asphaltene content and a relatively low sulfur content. Such hydrocarbons include, for example, those having (i) ≥about 0.1 wt % asphaltenes based on the weight of the first mixture's hydrocarbon component, e.g., ≥about 5.0 wt %; (ii) a final boiling point ≥600° F. (315° C.), generally ≥950° F. (510° C.), or ≥1100° F. (590° C.), or ≥1400° F. (760° C.); and optionally (iii)≤5 wt % sulfur, e.g., ≤1.0 wt % sulfur, such as ≤0.1 wt % sulfur. It is observed that utilizing an integrated vapor-liquid separator when pyrolysing these hydrocarbons in the presence of steam, the amount of olefin the SCT is ≤10.0 wt %, e.g., ≤5.0 wt %, such as ≤2.0 wt %, based on the weight of the SCT. More particularly, the amount of (i) vinyl aromatics in the SCT and/or (ii) aggregates in the SCT which incorporate vinyl aromatics is ≤5.0 wt %, e.g., ≤3 wt %, such as ≤2.0 wt %. While not wishing to be bound by any theory or model, it is believed that the amount of olefin in the SCT is lessened because precursors in the first mixture's hydrocarbon that would otherwise form $C_{6+}$ olefin in the SCT are separated from the first mixture in the vapor-liquid separator and conducted away from the process before the pyrolysis. Evidence of this feature is found by comparing the density of SCT obtained by crude oil pyrolysis. For conventional steam cracking of a crude oil fraction, such as vacuum gas oil, the SCT is observed to have an API gravity (measured at 15.6° C.) the range of about −1° API to about 6° API. API gravity is an inverse measure of the relative density, where a lesser (or more negative) API gravity value is an indication of greater SCT density. When the same hydrocarbon is pyrolysed utilizing an integrated vapor-liquid separator operating under the specified conditions, the SCT density is increased, e.g., to an API gravity ≤−7.5° API, such as ≤−8.0° API, or ≤−8.5° API.

Another advantage obtained when utilizing a vapor/liquid separator integrated with the pyrolysis furnace is that it increases the range of hydrocarbon types available to be used directly, without pretreatment, as hydrocarbon components in the first mixture. For example, the first mixture's hydrocarbon component can comprise ≥50.0 wt %, e.g., ≥75.0 wt %, such as ≥90.0 wt % (based on the weight of the first mixture's hydrocarbon) of one or more crude oils, even high naphthenic acid-containing crude oils and fractions thereof. Feeds having a high naphthenic acid content are among those that produce a high quantity of SCT and are especially suitable when at least one vapor/liquid separation device is integrated with the pyrolysis furnace. If desired, the first mixture's composition can vary over time, e.g., by utilizing a first mixture having a first hydrocarbon during a first time period and then, during a second time period, substituting for at least a portion of the first hydrocarbon a second hydrocarbon. The first and second hydrocarbons can be substantially different hydrocarbons or substantially different hydrocarbon mixtures. The first and second periods can be of substantially equal duration, but this is not required. Alternating first and second periods can be conducted in sequence continuously or semi-continuously (e.g., in "blocked" operation) if desired. This can be utilized for the sequential pyrolysis of incompatible first and second hydrocarbon components (i.e., where the first and second hydrocarbon components are mixtures that are not sufficiently compatible to be blended under ambient conditions). For example, the first mixture can comprise a first hydrocarbon during a first time period and a second hydrocarbon (one that is substantially incompatible with the first hydrocarbon) during a second time period. The first hydrocarbon can comprise, e.g., a virgin crude oil. The second hydrocarbon can comprise SCT.

Figure 3:
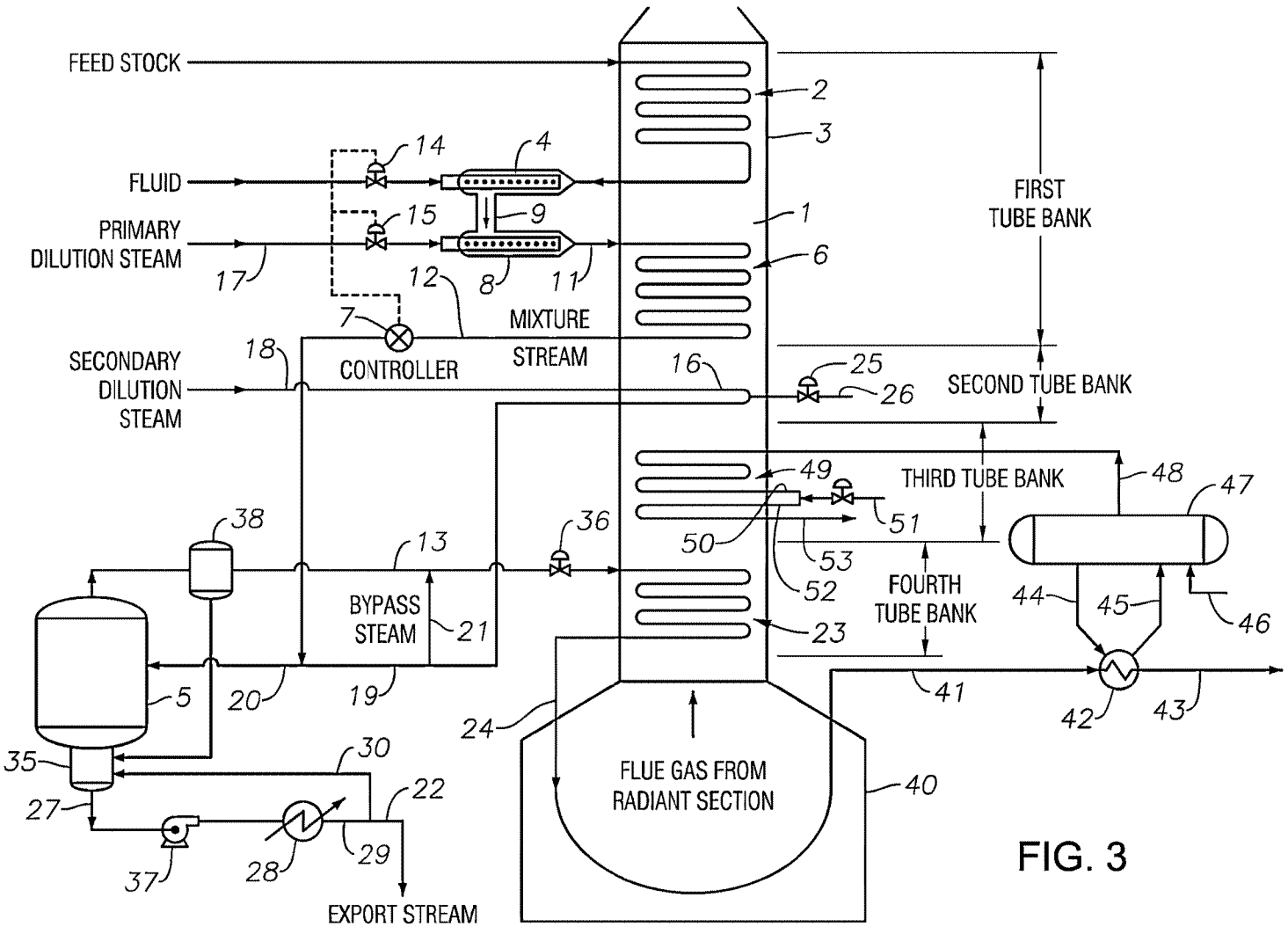
FIG. 3 schematically illustrates a pyrolysis furnace with optional integrated vapor-liquid separator device.

In certain aspects a pyrolysis furnace is integrated with a vapor-liquid separator device as illustrated schematically in FIG. 3. A hydrocarbon feed is introduced into furnace 1, the hydrocarbon being heated by indirect contact with hot flue gasses in the upper region (farthest from the radiant section) of the convection section. The heating is accomplished by passing at least a portion of the first mixture's hydrocarbon through a bank of heat exchange tubes 2 located within the convection section 3 of the furnace 1. The heated hydrocarbon typically has a temperature in the range of about 300 F.° and about 500° F. (150° C. to 260° C.), such as about 325° F. to about 450° F. (160° C. to 230° C.), for example about 340° F. to about 425° F. (170° C. to 220° C.). Diluent (primary dilution steam) 17 is combined with the heated hydrocarbon in sparger 8 and of double sparger 9. Additional fluid, such as one or more of additional hydrocarbon, steam, and water, such as boiler feed water, can be introduced into the heated hydrocarbon via sparger 4. Generally, the primary dilution steam stream 17 is injected into the first mixture's hydrocarbon before the combined hydrocarbon+steam mixture enters the convection section at 11, for additional heating by flue gas. The primary dilution steam generally has a temperature greater than that of the first mixture's hydrocarbon, in order to at least partially vaporize the first mixture's hydrocarbon. The first mixture is heated again in the convection section of the pyrolysis furnace 3 before the vapor-liquid separation, e.g., by passing the first mixture through a bank of heat exchange tubes 6. The first mixture leaves the convection section as a re-heated first mixture 12. An optional secondary dilution steam stream can be introduced via line 18. If desired, the re-heated first mixture can be further heated by combining it with the secondary dilution steam 18 upstream of vapor-liquid separation. Optionally, the secondary dilution steam is split into (i) a flash steam stream 19 for mixing with the re-heated first mixture 12 before vapor-liquid separation and (ii) a bypass steam stream 21. The bypass steam bypasses the vapor-liquid separation and is instead mixed with a vapor phase that is separated from the re-heated first mixture in the vapor-liquid separator. The mixing is carried out before the vapor phase is cracked in the radiant section of the furnace. Alternatively, the secondary dilution steam 18 is directed to bypass steam stream 21 with no flash steam stream 19. In certain aspects, the ratio of the flash steam stream 19 to bypass steam stream 21 is 1:20 to 20:1, e.g., 1:2 to 2:1. The flash steam stream 19 is then mixed with the re-heated first mixture 12 to form a flash stream 20 before the flash in vapor-liquid separator 5. Optionally, the secondary dilution steam stream is superheated in a superheater section 16 in the furnace convection before splitting and mixing with the heavy hydrocarbon mixture. The addition of the flash steam stream 19 to the first mixture 12 aids the vaporization of most volatile components of the first mixture before the flash stream 20 enters the vapor-liquid separation vessel 5. The first mixture 12 or the flash stream 20 is then flashed, for separation of two phases: a vapor phase comprising predominantly volatile hydrocarbons and steam, and a liquid phase comprising predominantly non-volatile hydrocarbons. The vapor phase is preferably removed from vessel 5 as an overhead vapor stream 13. The vapor phase can be transferred to a convection section tube bank 23 of the furnace, e.g., at a location proximate to the radiant section of the furnace, for optional heating and through crossover pipes 24 to the radiant section 40 of the pyrolysis furnace for cracking. The liquid phase of the flashed mixture stream is removed from vessel 5 as a bottoms stream 27.

Typically, the temperature of the first mixture 12 can be set and controlled in the range of about 600° F. to about 1000° F. (315° C. to 540° C.), in response, e.g., to changes of the concentration of volatiles in the first mixture. The temperature can be selected to maintain a liquid phase in line 12 and downstream thereof to reduce the likelihood of coke formation on exchanger tube walls and in the vapor-liquid separator. The first mixture's temperature can be controlled by a control system 7, which generally includes a temperature sensor and a control device, which can be an automated by way of a computer. The control system 7 communicates with the fluid valve 14 and the primary dilution steam valve 15 in order to regulate the amount of fluid and primary dilution steam entering dual sparger 9. An intermediate desuperheater 25 can be utilized, e.g., to further avoid sharp variation of the flash temperature. After partial preheating, the secondary dilution steam exits the convection section and a fine mist of desuperheater water 26 is added, which rapidly vaporizes and reduces the steam temperature. This allows the superheater 16 outlet temperature to be controlled at a constant value, independent of furnace load changes, coking extent changes, excess oxygen level changes, and other variables. When used, desuperheater 25 generally maintains the temperature of the secondary dilution steam in the range of about 800° F. to about 1100° F. (425° C. to 590° C.). In addition to maintaining a substantially constant temperature of the mixture stream 12 entering the flash/separator vessel, it is generally also desirable to maintain a constant hydrocarbon partial pressure of the flash stream 20 in order to maintain a substantially constant ratio of vapor to liquid in the flash/separator vessel. By way of examples, a substantially constant hydrocarbon partial pressure can be maintained through the use of control valve 36 on the vapor phase line 13 and by controlling the ratio of steam to hydrocarbon feedstock in stream 20. Typically, the hydrocarbon partial pressure of the flash stream in the present invention is set and controlled in a range of about 4 psia to about 25 psia (25 kPa to 175 kPa), such as in a range of about 5 psia to about 15 psia (35 kPa to 100 kPa), for example in a range of about 6 psia to about 11 psia (40 kPa to 75 kPa).

Conventional vapor-liquid separation conditions can be utilized in vapor-liquid separator 5, such as those disclosed in U.S. Pat. No. 7,820,035. When the first mixture's hydrocarbon component comprises one or more crude oil or fractions thereof, the vapor/liquid separation device can operate at a temperature in the range of from about 600° F. to about 950° F. (about 350° C. to about 510° C.) and a pressure in the range of about 275 kPa to about 1400 kPa, e.g., a temperature in the range of from about 430° C. to about 480° C. and a pressure in the range of about 700 kPa to 760 kPa. A vapor phase conducted away from the vapor/liquid separation device can be subjected to further heating in the convection section, as shown in the figure. The re-heated vapor phase is then introduced via crossover piping into the radiant section where the overheads are exposed to a temperature ≥760° C. at a pressure >0.5 bar (gauge) e.g., a temperature in the range of about 790° C. to about 850° C. and a pressure in the range of about 0.6 bar (gauge) to about 2.0 bar (gauge), to carry out the pyrolysis (e.g., cracking and/or reforming).

Accordingly, vapor portion of the first mixture is conducted away from vapor-liquid separator 5 via line 25 and valve 56 for cracking in radiant section 40 of the pyrolysis furnace. A liquid portion of the first mixture is conducted away from vapor-liquid separator 5 via line 27. Stream 27 can be conveyed from the bottom of the flash/separator vessel 5 to the cooler 28 via pump 37. The cooled stream 29 can then be split into a recycle stream 30 and export stream 22. Recycle liquid in line 30 can be returned to drum 5 proximate to bottom section 35. The vapor phase may contain, for example, about 55% to about 70% hydrocarbon (by weight) and about 30% to about 45% steam (by weight). The final boiling point of the vapor phase is generally ≤1400° F. (760° C.), such as ≤1100° F. (590° C.), for example below about 1050° F. (565° C.), or ≤about 1000° F. (540° C.). An optional centrifugal separator 38 can be used for removing from the vapor phase any entrained and/or condensed liquid. The vapor then returned to the furnace via a manifold that distributes the flow to the lower convection section 23 for heating, e.g., to a temperature in the range of about 800° F. to about 1300° F. (425° C. to 705° C.). The vapor phase is then introduced to the radiant section of the pyrolysis furnace to be cracked, optionally after mixing with bypass steam stream 21.

The radiant section's effluent can be rapidly cooled in a transfer-line exchanger 42 via line 41. Indirect cooling can be used, e.g., using water from a steam drum 47, via line 44, in a thermosyphon arrangement. Water can be added via line 46. The saturated steam 48 conducted away from the drum can be superheated in the high pressure steam superheater bank 49. The desuperheater can include a control valve/water atomizer nozzle 51, line 50 for transferring steam to the desuperheater, and line 52 for transferring steam away from the desuperheater. After partial heating, the high pressure steam exits the convection section via line 50 and water from 51 is added (e.g., as a fine mist) which rapidly vaporizes and reduces the temperature. The high pressure steam can be returned to the convection section via line 52 for further heating. The amount of water added to the superheater can control the temperature of the steam withdrawn via line 53.

After cooling in transfer-line exchanger 42, the pyrolysis effluent (the second mixture) is conducted away via line 43, e.g., for separating from the pyrolysis effluent one or more of molecular hydrogen, water, unconverted feed, SCT, gas oils, pyrolysis gasoline, ethylene, propylene, and $C_4$ olefin.

In aspects where a vapor-liquid separator is integrated with the pyrolysis furnace, the SCT generally comprises ≥50.0 wt % of the second mixture's TH based on the weight of the second mixture's TH, such as ≥90.0 wt %. For example, the SCT can have (i) a TH content in the range of from 5.0 wt % to 40.0 wt %, based on the weight of the SCT; (ii) an API gravity (measured at a temperature of 15.8° C.) of ≤−7.5° API, such as ≤−8.0° API, or ≤−8.5° API; and (iii) a 50° C. viscosity in the range of 200 cSt to 1.0×107 cSt. The SCT can have, e.g., a sulfur content that is ≥0.5 wt %, e.g., in the range of 0.5 wt % to 7.0 wt %. In aspects where the feed to the pyrolysis furnace does not contain an appreciable amount of sulfur, the SCT can be comprise ≤0.5 wt % sulfur, based on the weight of the SCT, e.g., ≤0.1 wt %, such as ≤0.05 wt %. The amount of olefin the SCT is generally ≤10.0 wt %, e.g., ≤5.0 wt %, such as ≤2.0 wt %, based on the weight of the SCT. More particularly, the amount of (i) vinyl aromatics in the SCT is generally ≤5.0 wt %, e.g., ≤3.0 wt %, such as ≤2.0 wt % and/or (ii) aggregates in the SCT which incorporate vinyl aromatics is generally ≤5.0 wt %, e.g., ≤3.0 wt %, such as ≤2.0 wt %, the weight percents being based on the weight of the SCT. In an embodiment, the second mixture's tar stream (SCT) comprises (i) ≥10.0 wt % of molecules having an atmospheric boiling point ≥565° C. that are not asphaltenes, and (ii) $\leq 1.0\times10^3$ ppmw metals, the weight percents being based on the weight of the second mixture's tar.

The tar stream is generally conducted away from the separation stage for hydroprocessing in the presence of utility fluid. A pyrolysis tar hydroprocessing process will now be described utilizing utility fluid. Non-limiting examples of suitable processes include those disclosed in International Patent Application Publication Nos. WO 2013/033590, WO 2013/033582, and WO 2013/033580 which are incorporated by reference herein in their entirety.

Hydroprocessing Pyrolysis Tar

The utility fluid is utilized in hydroprocessing the tar stream, e.g., for effectively increasing run-length during hydroprocessing. The relative amounts of utility fluid and tar stream during hydroprocessing are generally in the range of from about 20.0 wt % to about 95.0 wt % of the tar stream and from about 5.0 wt % to about 80.0 wt % of the utility fluid, based on total weight of utility fluid plus tar stream. For example, the relative amounts of utility fluid and tar stream during hydroprocessing can be in the range of (i) about 20.0 wt % to about 90.0 wt % of the tar stream and about 10.0 wt % to about 80.0 wt % of the utility fluid, or (ii) from about 40.0 wt % to about 90.0 wt % of the tar stream and from about 10.0 wt % to about 60.0 wt % of the utility fluid. In an embodiment, the utility fluid:tar weight ratio can be ≥0.01, e.g., in the range of 0.05 to 4.0, such as in the range of 0.1 to 3.0, or 0.3 to 1.1. At least a portion of the utility fluid can be combined with at least a portion of the tar stream within the hydroprocessing vessel or hydroprocessing zone, but this is not required, and in one or more embodiments at least a portion of the utility fluid and at least a portion of the tar stream are supplied as separate streams and combined into one feed stream prior to entering (e.g., upstream of) the hydroprocessing stage(s). For example, the tar stream and utility fluid can be combined to produce a feedstock upstream of the hydroprocessing stage, the feedstock comprising, e.g., (i) about 20.0 wt % to about 90.0 wt % of the tar stream and about 10.0 wt % to about 80.0 wt % of the utility fluid, or (ii) from about 40.0 wt % to about 90.0 wt % of the tar stream and from about 10.0 wt % to about 60.0 wt % of the utility fluid, the weight percents being based on the weight of the feedstock. The feedstock can be conducted to the hydroprocessing stage for the hydroprocessing.

Hydroprocessing of the tar stream in the presence of the utility fluid can occur in one or more hydroprocessing stages, the stages comprising one or more hydroprocessing vessels or zones. Vessels and/or zones within the hydroprocessing stage in which catalytic hydroprocessing activity occurs generally include at least one hydroprocessing catalyst. The catalysts can be mixed or stacked, such as when the catalyst is in the form of one or more fixed beds in a vessel or hydroprocessing zone.

Conventional hydroprocessing catalyst can be utilized for hydroprocessing the tar stream in the presence of the utility fluid, such as those specified for use in resid and/or heavy oil hydroprocessing, but the invention is not limited thereto. Suitable hydroprocessing catalysts include those comprising (i) one or more bulk metals and/or (ii) one or more metals on a support. The metals can be in elemental form or in the form of a compound. In one or more embodiments, the hydroprocessing catalyst includes at least one metal from any of Groups 5 to 10 of the Periodic Table of the Elements (tabulated as the Periodic Chart of the Elements, The Merck Index, Merck & Co., Inc., 1996). Examples of such catalytic metals include, but are not limited to, vanadium, chromium, molybdenum, tungsten, manganese, technetium, rhenium, iron, cobalt, nickel, ruthenium, palladium, rhodium, osmium, iridium, platinum, or mixtures thereof.

In one or more embodiments, the catalyst has a total amount of Groups 5 to 10 metals per gram of catalyst of at least 0.0001 grams, or at least 0.001 grams or at least 0.01 grams, in which grams are calculated on an elemental basis. For example, the catalyst can comprise a total amount of Group 5 to 10 metals in a range of from 0.0001 grams to 0.6 grams, or from 0.001 grams to 0.3 grams, or from 0.005 grams to 0.1 grams, or from 0.01 grams to 0.08 grams. In a particular embodiment, the catalyst further comprises at least one Group 15 element. An example of a preferred Group 15 element is phosphorus. When a Group 15 element is utilized, the catalyst can include a total amount of elements of Group 15 in a range of from 0.000001 grams to 0.1 grams, or from 0.00001 grams to 0.06 grams, or from 0.00005 grams to 0.03 grams, or from 0.0001 grams to 0.001 grams, in which grams are calculated on an elemental basis.

In an embodiment, the catalyst comprises at least one Group 6 metal. Examples of preferred Group 6 metals include chromium, molybdenum and tungsten. The catalyst may contain, per gram of catalyst, a total amount of Group 6 metals of at least 0.00001 grams, or at least 0.01 grams, or at least 0.02 grams, in which grams are calculated on an elemental basis. For example the catalyst can contain a total amount of Group 6 metals per gram of catalyst in the range of from 0.0001 grams to 0.6 grams, or from 0.001 grams to 0.3 grams, or from 0.005 grams to 0.1 grams, or from 0.01 grams to 0.08 grams, the number of grams being calculated on an elemental basis.

In related embodiments, the catalyst includes at least one Group 6 metal and further includes at least one metal from Group 5, Group 7, Group 8, Group 9, or Group 10. Such catalysts can contain, e.g., the combination of metals at a molar ratio of Group 6 metal to Group 5 metal in a range of from 0.1 to 20, 1 to 10, or 2 to 5, in which the ratio is on an elemental basis. Alternatively, the catalyst will contain the combination of metals at a molar ratio of Group 6 metal to a total amount of Groups 7 to 10 metals in a range of from 0.1 to 20, 1 to 10, or 2 to 5, in which the ratio is on an elemental basis.

When the catalyst includes at least one Group 6 metal and one or more metals from Groups 9 or 10, e.g., molybdenum-cobalt and/or tungsten-nickel, these metals can be present, e.g., at a molar ratio of Group 6 metal to Groups 9 and 10 metals in a range of from 1 to 10, or from 2 to 5, in which the ratio is on an elemental basis. When the catalyst includes at least one of Group 5 metal and at least one Group 10 metal, these metals can be present, e.g., at a molar ratio of Group 5 metal to Group 10 metal in a range of from 1 to 10, or from 2 to 5, where the ratio is on an elemental basis. Catalysts which further comprise inorganic oxides, e.g., as a binder and/or support, are within the scope of the invention. For example, the catalyst can comprise (i) ≥1.0 wt % of one or more metals selected from Groups 6, 8, 9, and 10 of the Periodic Table and (ii) ≥1.0 wt % of an inorganic oxide, the weight percents being based on the weight of the catalyst.

In one or more embodiments, the catalyst is a bulk multimetallic hydroprocessing catalyst with or without binder. In an embodiment the catalyst is a bulk trimetallic catalyst comprised of two Group 8 metals, preferably Ni and Co and the one Group 6 metals, preferably Mo.

The invention encompasses incorporating into (or depositing on) a support one or catalytic metals e.g., one or more metals of Groups 5 to 10 and/or Group 15, to form the hydroprocessing catalyst. The support can be a porous material. For example, the support can comprise one or more refractory oxides, porous carbon-based materials, zeolites, or combinations thereof suitable refractory oxides include, e.g., alumina, silica, silica-alumina, titanium oxide, zirconium oxide, magnesium oxide, and mixtures thereof. Suitable porous carbon-based materials include, activated carbon and/or porous graphite. Examples of zeolites include, e.g., Y-zeolites, beta zeolites, mordenite zeolites, ZSM-5 zeolites, and ferrierite zeolites. Additional examples of support materials include gamma alumina, theta alumina, delta alumina, alpha alumina, or combinations thereof. The amount of gamma alumina, delta alumina, alpha alumina, or combinations thereof, per gram of catalyst support, can be in a range of from 0.0001 grams to 0.99 grams, or from 0.001 grams to 0.5 grams, or from 0.01 grams to 0.1 grams, or at most 0.1 grams, as determined by x-ray diffraction. In a particular embodiment, the hydroprocessing catalyst is a supported catalyst, the support comprising at least one alumina, e.g., theta alumina, in an amount in the range of from 0.1 grams to 0.99 grams, or from 0.5 grams to 0.9 grams, or from 0.6 grams to 0.8 grams, the amounts being per gram of the support. The amount of alumina can be determined using, e.g., x-ray diffraction. In alternative embodiments, the support can comprise at least 0.1 grams, or at least 0.3 grams, or at least 0.5 grams, or at least 0.8 grams of theta alumina.

When a support is utilized, the support can be impregnated with the desired metals to form the hydroprocessing catalyst. The support can be heat-treated at temperatures in a range of from 400° C. to 1200° C., or from 450° C. to 1000° C., or from 600° C. to 900° C., prior to impregnation with the metals. In certain embodiments, the hydroprocessing catalyst can be formed by adding or incorporating the Groups 5 to 10 metals to shaped heat-treated mixtures of support. This type of formation is generally referred to as overlaying the metals on top of the support material. Optionally, the catalyst is heat treated after combining the support with one or more of the catalytic metals, e.g., at a temperature in the range of from 150° C. to 750° C., or from 200° C. to 740° C., or from 400° C. to 730° C. Optionally, the catalyst is heat treated in the presence of hot air and/or oxygen-rich air at a temperature in a range between 400° C. and 1000° C. to remove volatile matter such that at least a portion of the Groups 5 to 10 metals are converted to their corresponding metal oxide. In other embodiments, the catalyst can be heat treated in the presence of oxygen (e.g., air) at temperatures in a range of from 35° C. to 500° C., or from 100° C. to 400° C., or from 150° C. to 300° C. Heat treatment can take place for a period of time in a range of from 1 to 3 hours to remove a majority of volatile components without converting the Groups 5 to 10 metals to their metal oxide form. Catalysts prepared by such a method are generally referred to as "uncalcined" catalysts or "dried." Such catalysts can be prepared in combination with a sulfiding method, with the Groups 5 to 10 metals being substantially dispersed in the support. When the catalyst comprises a theta alumina support and one or more Groups 5 to 10 metals, the catalyst is generally heat treated at a temperature ≥400° C. to form the hydroprocessing catalyst. Typically, such heat treating is conducted at temperatures ≤1200° C.

The catalyst can be in shaped forms, e.g., one or more of discs, pellets, extrudates, etc., though this is not required. Non-limiting examples of such shaped forms include those having a cylindrical symmetry with a diameter in the range of from about 0.79 mm to about 3.2 mm ($1/32^{nd}$ to $1/8^{th}$ inch), from about 1.3 mm to about 2.5 mm ($1/20^{th}$ to $1/10^{th}$ inch), or from about 1.3 mm to about 1.6 mm ($1/20^{th}$ to $1/16^{th}$ inch). Similarly-sized non-cylindrical shapes are within the scope of the invention, e.g., trilobe, quadralobe, etc. Optionally, the catalyst has a flat plate crush strength in a range of from 50-500 N/cm, or 60-400 N/cm, or 100-350 N/cm, or 200-300 N/cm, or 220-280 N/cm.

Porous catalysts, including those having conventional pore characteristics, are within the scope of the invention. When a porous catalyst is utilized, the catalyst can have a pore structure, pore size, pore volume, pore shape, pore surface area, etc., in ranges that are characteristic of conventional hydroprocessing catalysts, though the invention is not limited thereto. For example, the catalyst can have a median pore size that is effective for hydroprocessing SCT molecules, such catalysts having a median pore size in the range of from 30 Å to 1000 Å, or 50 Å to 500 Å, or 60 Å to 300 Å. Pore size can be determined according to ASTM Method D4284-07 Mercury Porosimetry.

In a particular embodiment, the hydroprocessing catalyst has a median pore diameter in a range of from 50 Å to 200 Å. Alternatively, the hydroprocessing catalyst has a median pore diameter in a range of from 90 Å to 180 Å, or 100 Å to 140 Å, or 110 Å to 130 Å. In another embodiment, the hydroprocessing catalyst has a median pore diameter ranging from 50 Å to 150 Å. Alternatively, the hydroprocessing catalyst has a median pore diameter in a range of from 60 Å to 135 Å, or from 70 Å to 120 Å. In yet another alternative, hydroprocessing catalysts having a larger median pore diameter are utilized, e.g., those having a median pore diameter in a range of from 180 Å to 500 Å, or 200 Å to 300 Å, or 230 Å to 250 Å.

Generally, the hydroprocessing catalyst has a pore size distribution that is not so great as to significantly degrade catalyst activity or selectivity. For example, the hydroprocessing catalyst can have a pore size distribution in which at least 60% of the pores have a pore diameter within 45 Å, 35 Å, or 25 Å of the median pore diameter. In certain embodiments, the catalyst has a median pore diameter in a range of from 50 Å to 180 Å, or from 60 Å to 150 Å, with at least 60% of the pores having a pore diameter within 45 Å, 35 Å, or 25 Å of the median pore diameter.

When a porous catalyst is utilized, the catalyst can have, e.g., a pore volume ≥0.3 $cm^3/g$, such ≥0.7 $cm^3/g$, or ≥0.9 $cm^3/g$. In certain embodiments, pore volume can range, e.g., from 0.3 $cm^3/g$ to 0.99 $cm^3/g$, 0.4 $cm^3/g$ to 0.8 $cm^3/g$, or 0.5 $cm^3/g$ to 0.7 $cm^3/g$.

In certain embodiments, a relatively large surface area can be desirable. As an example, the hydroprocessing catalyst can have a surface area ≥60 $m^2/g$, or ≥100 $m^2/g$, or ≥120 $m^2/g$, or ≥170 $m^2/g$, or ≥220 $m^2/g$, or ≥270 $m^2/g$; such as in the range of from 100 $m^2/g$ to 300 $m^2/g$, or 120 $m^2/g$ to 270 $m^2/g$, or 130 $m^2/g$ to 250 $m^2/g$, or 170 $m^2/g$ to 220 $m^2/g$.

Conventional hydrotreating catalysts can be used, but the invention is not limited thereto. In certain embodiments, the catalysts include one or more of KF860 available from Albemarle Catalysts Company LP, Houston Tex.; Nebula® Catalyst, such as Nebula® 20, available from the same source; Centera® catalyst, available from Criterion Catalysts and Technologies, Houston Tex., such as one or more of DC-2618, DN-2630, DC-2635, and DN-3636; Ascent® Catalyst, available from the same source, such as one or more of DC-2532, DC-2534, and DN-3531; and FCC pretreat catalyst, such as DN3651 and/or DN3551, available from the same source. However, the invention is not limited to only these catalysts.

Hydroprocessing the specified amounts of tar stream and utility fluid using the specified hydroprocessing catalyst and specified utility fluid leads to improved catalyst life, e.g., allowing the hydroprocessing stage to operate for at least 3 months, or at least 6 months, or at least 1 year without replacement of the catalyst in the hydroprocessing or contacting zone. Catalyst life is generally ≥10 times longer than would be the case if no utility fluid were utilized, e.g., ≥100 times longer, such as ≥1000 times longer.

The amount of coking in the hydroprocessing or contacting zone is relatively small and run lengths ≥10 days, or ≥30 days, or ≥100 days, or even ≥500 days are observed with ≤10.0%, preferably ≤1% increase in reactor pressure drop over its start-of-run ("SOR") value, as calculated by ([Observed pressure drop−Pressure $drop_{SOR}$]/Pressure $drop_{SOR}$)* 100%. However, sub-optimal operating conditions, e.g. process upsets, can make reactor decoking desirable. For SCT hydroprocessing in accordance with the invention, it has been found that the coke formed in the hydroprocessing or contacting zone is at least weakly soluble in the utility fluid.

The hydroprocessing is carried out in the presence of hydrogen, e.g., by (i) combining molecular hydrogen with the tar stream and/or utility fluid upstream of the hydroprocessing and/or (ii) conducting molecular hydrogen to the hydroprocessing stage in one or more conduits or lines. Although relatively pure molecular hydrogen can be utilized for the hydroprocessing, it is generally desirable to utilize a "treat gas" which contains sufficient molecular hydrogen for the hydroprocessing and optionally other species (e.g., nitrogen and light hydrocarbons such as methane) which generally do not adversely interfere with or affect either the reactions or the products. Unused treat gas can be separated from the hydroprocessed product for re-use, generally after removing undesirable impurities, such as $H_2S$ and $NH_3$. The treat gas optionally contains ≥about 50 vol. % of molecular hydrogen, e.g., ≥about 75 vol. %, based on the total volume of treat gas conducted to the hydroprocessing stage.

Optionally, the amount of molecular hydrogen supplied to the hydroprocessing stage is in the range of from about 300 SCF/B (standard cubic feet per barrel) (53 S $m^3/m^3$) to 5000 SCF/B (890 S $m^3/m^3$), in which B refers to barrel of feed to the hydroprocessing stage (e.g., tar stream plus utility fluid). For example, the molecular hydrogen can be provided in a range of from 1000 SCF/B (178 S $m^3/m^3$) to 3000 SCF/B (534 S $m^3/m^3$). Hydroprocessing the tar stream in the presence of the specified utility fluid, molecular hydrogen, and a catalytically effective amount of the specified hydroprocessing catalyst under catalytic hydroprocessing conditions produces a hydroprocessed product including, e.g., upgraded SCT. Preferably, the amount of molecular hydrogen required to hydroprocess the specified tar stream is less than if the tar stream contained higher amounts of $C_{6+}$ olefin, for example, vinyl aromatics. Optionally, higher amounts of molecular hydrogen may be supplied, for example, when the tar stream contains relatively higher amounts of sulfur. An example of suitable catalytic hydroprocessing conditions will now be described in more detail. The invention is not limited to these conditions, and this description is not meant to foreclose other hydroprocessing conditions within the broader scope of the invention.

The hydroprocessing is generally carried out under hydroconversion conditions, e.g., under conditions for carrying out one or more of hydrocracking (including selective hydrocracking), hydrogenation, hydrotreating, hydrodesulfurization, hydrodenitrogenation, hydrodemetallation, hydrodearomatization, hydroisomerization, or hydrodewaxing of the specified tar stream. The hydroprocessing reaction can be carried out in at least one vessel or zone that is located, e.g., within a hydroprocessing stage downstream of the pyrolysis stage and separation stage. The specified tar stream generally contacts the hydroprocessing catalyst in the vessel or zone, in the presence of the utility fluid and molecular hydrogen. Catalytic hydroprocessing conditions can include, e.g., exposing the combined diluent-tar stream to a temperature in the range from 50° C. to 500° C. or from 200° C. to 450° C. or from 220° C. to 430° C. or from 350° C. to 420° C. proximate to the molecular hydrogen and hydroprocessing catalyst. For example, a temperature in the range of from 300° C. to 500° C., or 350° C. to 430° C., or 360° C. to 420° C. can be utilized. Liquid hourly space velocity (LHSV) of the combined diluent-tar stream will generally range from 0.1 $h^{-1}$ to 30 $h^{-1}$, or 0.4 $h^{-1}$ to 25 $h^{-1}$, or 0.5 $h^{-1}$ to 20 $h^{-1}$. In some embodiments, LHSV is at least 5 $h^{-1}$, or at least 10 $h^{-1}$, or at least 15 $h^{-1}$. Molecular hydrogen partial pressure during the hydroprocessing is generally in the range of from 0.1 MPa to 8 MPa, or 1 MPa to 7 MPa, or 2 MPa to 6 MPa, or 3 MPa to 5 MPa. In some embodiments, the partial pressure of molecular hydrogen is ≤7 MPa, or ≤6 MPa, or ≤5 MPa, or ≤4 MPa, or ≤3 MPa, or ≤2.5 MPa, or ≤2 MPa. The hydroprocessing conditions can include, e.g., one or more of a temperature in the range of 300° C. to 500° C., a pressure in the range of 15 bar (absolute) to 135 bar, or 20 bar to 120 bar, or 20 bar to 100 bar, a space velocity (LHSV) in the range of 0.1 to 5.0, and a molecular hydrogen consumption rate of about 53 standard cubic meters/cubic meter (S $m^3/m^3$) to about 445 S $m^3/m^3$ (300 SCF/B to 2500 SCF/B, where the denominator represents barrels of the tar stream, e.g., barrels of SCT). In one or more embodiment, the hydroprocessing conditions include one or more of a temperature in the range of 380° C. to 430° C., a pressure in the range of 21 bar (absolute) to 81 bar (absolute), a space velocity in the range of 0.2 to 1.0, and a hydrogen consumption rate of about 70 S $m^3/m^3$ to about 267 S $m^3/m^3$ (400 SCF/B to 1500 SCF/B). When operated under these conditions using the specified catalyst, TH hydroconversion conversion is generally ≥25.0% on a weight basis, e.g., ≥50.0%.

Separating Utility Fluid from Hydroprocessed Product

It has been discovered that the specified utility fluid may be produced as part of a process for hydroprocessing pyrolysis tar. In certain aspects, e.g., those depicted in FIGS. 4 and 5, the hydroprocessed effluent comprises unused treat gas, including impurities, and a hydroprocessed product. A specific mid-cut portion of a hydroprocessed product may be separated and utilized as utility fluid. It has been surprisingly discovered that, after a startup transition period, the pyrolysis tar hydroprocessing process equilibrates so that the mid-cut portion comprises the specified utility fluid composition. Additionally, the pyrolysis tar hydroprocessing process may produce sufficient mid-cut to sustain the process without any make-up or supplemental utility fluid from a source external to the process.

The hydroprocessed product is separated from the hydroprocessed effluent so that the amount of hydroprocessed product is approximately 95.0 wt % of the total liquid feed to the reactor. The vapor phase of the hydroprocessed effluent comprises, e.g., molecular hydrogen, methane, and hydrogen sulfide.

In certain aspects, the hydroprocessed product is separated into overhead, mid-cut, and bottoms streams. The overhead comprises from 0 wt % to 20 wt % of the hydroprocessed product. The mid-cut comprises from 20 to 70 wt % of the hydroprocessed product. The bottoms comprises from 20 to 70 wt % of the hydroprocessed product.

In other aspects, the overhead comprises from 5 wt % to 10 wt % of the hydroprocessed product. The mid-cut comprises from 30 to 60 wt % of the hydroprocessed product. The bottoms comprises from 30 to 70 wt % of the hydroprocessed product.

The overhead, mid-cut, and bottoms portions can be separated by fractionation, for example, in one or more distillation towers, or by vapor-liquid separation, for example, by one or more vapor-liquid separators. Describing the separated portions of the hydroprocessed product as overhead, mid-cut, and bottoms is not intended to preclude separation methods other than fractionating in a distillation tower. For example, the mid-cut may be separated via a flash drum overhead or flash drum bottoms. The overhead, mid-cut, and bottoms portions can be separated by conventional separations means, e.g., one or more flash drums, splitters, fractionation towers, membranes, absorbents, etc., though the invention is not limited thereto.

In certain aspects, at least a portion of the mid-cut may be recycled and used as utility fluid. It has been discovered that separating the hydroprocessed product into the specified weight based portions, produces mid-cut that meets the qualities of the specified utility fluid. In other words, the mid-cut can comprise, consist essentially of, or consist of ≥1.0 wt % of 1.0 ring class compounds, ≥5.0 wt % of 1.5 ring class compounds, ≥5.0 wt % of 2.0 ring class compounds, and ≤0.1 wt % of 5.0 ring class compounds, where the weight percents are based on the weight of the mid-cut.

Preferably, the mid-cut comprises ≥5.0 wt % of 1.0 ring class compounds, ≥15.0 wt % of 1.5 ring class compounds, ≥10.0 wt % of 2.0 ring class compounds, and ≤0.1 wt % of 5.0 ring class compounds, where the weight percents are based on the weight of the mid-cut. More preferably, the mid-cut comprises ≥5.0 wt % of 1.0 ring class compounds, ≥35.0 wt % of 1.5 ring class compounds, ≥20.0 wt % of 2.0 ring class compounds, and ≤0.1 wt % of 5.0 ring class compounds, where the weight percents are based on the weight of the mid-cut.

The mid-cut can comprise ≤20 wt % of 1.0 ring class compound based on the weight of the mid-cut. The mid-cut can comprise ≤1.0 wt % of 4.0 ring class compounds based on the weight of the utility fluid. The mid-cut can comprise ≤1.0 wt % of 3.0 ring class compounds based on the weight of the mid-cut.

In an embodiment, the mid-cut has high solvency as indicated by solubility blending number ("$S_{BN}$")≥90, preferably $S_{BN}$≥100, e.g., ≥110. In a preferred embodiment, sufficient mid-cut is recycled as utility fluid to sustain the hydroprocessing process without any make-up or supplemental utility fluid from an outside source.

The overhead and bottoms portions may be carried away for further processing. If desired, at least a portion of the bottoms can be utilized within the process and/or conducted away for storage or further processing. The bottoms can be desirable as a diluent (e.g., a flux) for heavy hydrocarbons, especially those of relatively high viscosity. In this regard, the bottoms can substitute for more expensive, conventional diluents. Non-limiting examples of heavy, high-viscosity streams suitable for blending with the bottoms include one or more of bunker fuel, burner oil, heavy fuel oil (e.g., No. 5 or No. 6 fuel oil), high-sulfur fuel oil, low-sulfur fuel oil, regular-sulfur fuel oil (RSFO), and the like. Optionally, trim molecules may be separated, for example, in a fractionator, from bottoms or overhead or both and added to the mid-cut as desired.

Primer Fluid

As described, it has surprisingly been discovered that hydroprocessing pyrolysis tar may produce sufficient utility fluid to sustain the hydroprocessing process without any make-up or supplemental utility fluid from an outside source. Nevertheless, in accordance with the invention, a primer fluid may be provided to start the hydroprocessing process producing utility fluid. Once the pyrolysis tar hydroprocessing process is producing sufficient utility fluid, the primer fluid flow may be reduced or stopped and replaced by at least a portion or all of the newly produced utility fluid. One having ordinary skill in the art will understand the usage of utility fluid described previously, including rates, amounts, and ratios, also applies to usage of the primer fluid (including rates, amounts, and ratios) to start the pyrolysis tar hydroprocessing process.

The primer fluid comprises qualities similar to the specified utility fluid but not necessarily identical. Generally, the primer fluid comprises to a large extent a mixture of multi-ring compounds. The rings can be aromatic or non-aromatic and can contain a variety of substituents and/or heteroatoms. For example, the primer fluid can contain, e.g., ≥40.0 wt %, ≥45.0 wt %, ≥50.0 wt %, ≥55.0 wt %, or ≥60.0 wt %, based on the weight of the primer fluid, of aromatic and non-aromatic ring compounds.

The primer fluid can have an ASTM D86 10% distillation point ≥60° C. and a 90% distillation point ≤350° C. Optionally, the primer fluid (which can be a solvent or mixture of solvents) has an ASTM D86 10% distillation point ≥120° C., e.g., ≥140° C., such as ≥150° C. and/or an ASTM D86 90% distillation point ≤300° C.

In one or more embodiments, the primer fluid (i) has a critical temperature in the range of 285° C. to 400° C., and (ii) comprises ≥80.0 wt % of 1-ring aromatics and/or 2-ring aromatics, including alkyl-functionalized derivatives thereof, based on the weight of the primer fluid. For example, the primer fluid can comprise, e.g., ≥90.0 wt % of a single-ring aromatic, including those having one or more hydrocarbon substituents, such as from 1 to 3 or 1 to 2 hydrocarbon substituents. Such substituents can be any hydrocarbon group that is consistent with the overall solvent distillation characteristics. Examples of such hydrocarbon groups include, but are not limited to, those selected from the group consisting of $C_1$-$C_6$ alkyl, wherein the hydrocarbon groups can be branched or linear and the hydrocarbon groups can be the same or different. Optionally, the primer fluid comprises ≥90.0 wt % based on the weight of the primer fluid of one or more of benzene, ethylbenzene, trimethylbenzene, xylenes, toluene, naphthalenes, alkylnaphthalenes (e.g., methylnaphtalenes), tetralins, or alkyltetralins (e.g., methyltetralins).

In certain embodiments, the primer fluid comprises steam cracked naptha ("SCN") and/or steam cracked gas oil ("SCGO"), e.g., SCN and/or SCGO separated in a primary fractionator downstream of a pyrolysis furnace operating under steam cracking conditions. Optionally, the SCN or SCGO can be hydrotreated in different conventional hydrotreaters (e.g. not hydrotreated with the tar). The primer fluid can comprise, e.g., ≥50.0 wt % of the separated gas oil, based on the weight of the primer fluid.

Optionally, the primer fluid comprises commercially available solvents. For example, in one embodiment, the primer fluid comprises one or a combination of Aromatic 100, Aromatic 150, or Aromatic 200 solvent, available from ExxonMobil Chemical.

Preferably the primer fluid has high solvency as measured by solubility blending number ("$S_{BN}$"). The primer fluid can have $S_{BN}$≥90. More preferably, the utility fluid has $S_{BN}$≥100, e.g., ≥110.

It is generally desirable for the primer fluid to be substantially free of molecules having terminal unsaturates, for example, vinyl aromatics, particularly in embodiments utilizing a hydroprocessing catalyst having a tendency for coke formation in the presence of such molecules. In an embodiment, the primer fluid comprises ≤10.0 wt %, e.g., ≤5.0 wt %, ≤1.0 wt %, vinyl aromatics, based on the weight of the primer fluid.

Generally, the primer fluid contains sufficient amount of molecules having one or more aromatic cores to effectively increase run length of the pyrolysis tar hydroprocessing process. For example, the primer fluid can comprise ≥50.0 wt % of molecules having at least one aromatic core, e.g., ≥60.0 wt %, such as ≥70 wt %, based on the total weight of the primer fluid. In an embodiment, the primer fluid comprises (i) ≥60.0 wt % of molecules having at least one aromatic core and (ii)≤1.0 wt % of vinyl aromatics, the weight percents being based on the weight of the primer fluid.

Figure 4:
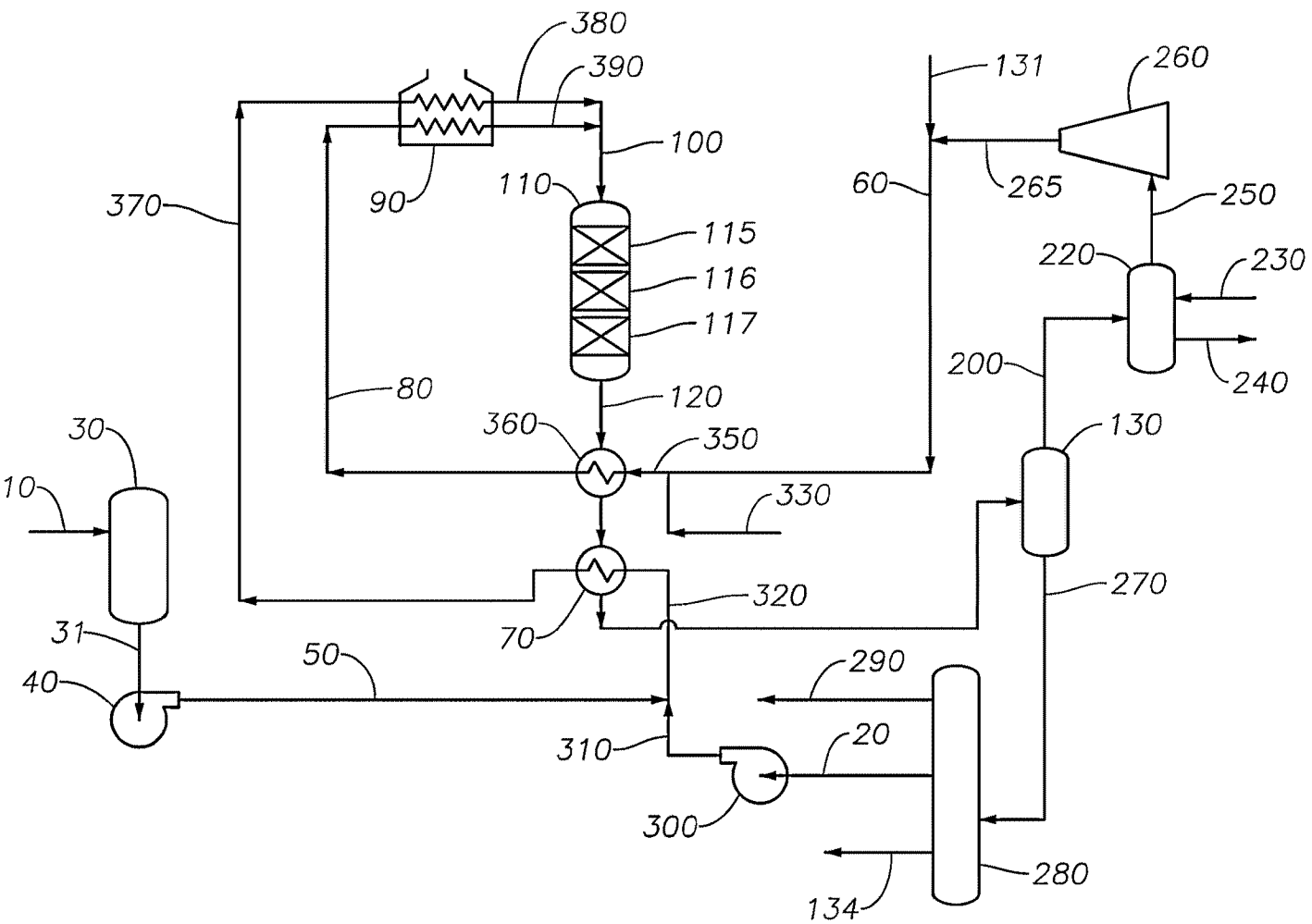
FIGS. 4 and 5 schematically illustrate a pyrolysis tar hydroprocessing process.

Hydroprocessing Pyrolysis Tar Using a Primer Fluid to Start the Process Producing Utility Fluid An embodiment of the pyrolysis tar hydroprocessing process is shown schematically in FIG. 4. A tar stream comprising pyrolysis tar, such as SCT, is provided via conduit 61 to separation stage 62 for separation of light gases from the tar stream. The degassed tar stream is conducted via conduit 63 to pump 64 to increase tar stream pressure, the higher-pressure tar stream being conducted away via conduit 65. A primer fluid conducted via conduit 330 is combined with the tar stream of conduit 65, with the combined streams being conducted to exchanger 70 via conduit 320.

The combined liquid stream is conducted to preheat stage 90 via conduit 370. A treat gas comprising molecular hydrogen is obtained from conduits 131 and/or 265. The treat gas is conducted via conduit 60 to an exchanger 360, the heated treat gas being conducted to a pre-heat stage 90 via conduit 80. A pre-heated mixture of primer fluid and tar stream (from conduit 380) is combined with the pre-heated treat gas (from conduit 390) and then conducted via conduit 100 to hydroprocessing stage 110. Mixing means can be utilized for combining the pre-heated tar-primer fluid mixture with the pre-heated treat gas in hydroprocessing stage 110, e.g., mixing means may be one or more gas-liquid distributors of the type conventionally utilized in fixed bed reactors. The tar stream is hydroprocessed in the presence of the primer fluid, the treat gas, and one or more of the specified hydroprocessing catalyst, the hydroprocessing catalyst being deployed within hydroprocessing stage 110 in at least one catalyst bed 115. Additional catalyst beds, e.g., 116, 117, etc., with intercooling quench using treat gas, from conduit 60 provided between beds, if desired.

Hydroprocessed effluent is conducted away from stage 110 via conduit 120. Heat can be transferred from the hydroprocessed product to the treat gas and combined SCT-utility fluid mixture via exchangers 360 and 70, as shown in FIG. 4. Following these exchangers, the hydroprocessed effluent is conducted to a separation stage 130 for separating total vapor product (e.g., heteroatom vapor, vapor-phase cracked products, unused treat gas, etc.) and hydroprocessed product (e.g., hydroprocessed tar) from the hydroprocessed effluent. In one embodiment, separation stage 130 is a flash drum. In one embodiment, the amount of hydroprocessed product is about 95.0 wt % of the total liquid feed (combined primer fluid and tar stream from conduit 380) to hydroprocessing stage 110.

The total vapor product is conducted away from stage 130 via conduit 200 to upgrading stage 220, which comprises, e.g., one or more amine towers. Fresh amine is conducted to stage 220 via line 230, with rich amine conducted away via conduit 240. At least a portion of the upgraded treat gas is conducted away from stage 220 via conduit 250, compressed in compressor 260, and conducted via conduit 265, 60, and 80 for re-cycle and re-use in the hydroprocessing stage 110. Treat gas, e.g., molecular hydrogen for starting up the process or for make-up, can be obtained from line 131 if needed.

The hydroprocessed product is conducted away from stage 130 via conduit 270 to separation stage 280. A bottoms stream comprising from 20 to 70 wt % of the hydroprocessed product is separated and carried away via conduit 134. An overhead stream comprising from 0 wt % to 20 wt % of the hydroprocessed product is separated and carried away via conduit 290. A mid-cut stream comprising from 20 to 70 wt % of the hydroprocessed product is separated and conducted to pump 300 via conduit 20. At this point, the flow of primer fluid via conduit 330 may be reduced or stopped and at least a portion of the mid-cut can be recycled via conduit 310 to be used as utility fluid.

Figure 5:
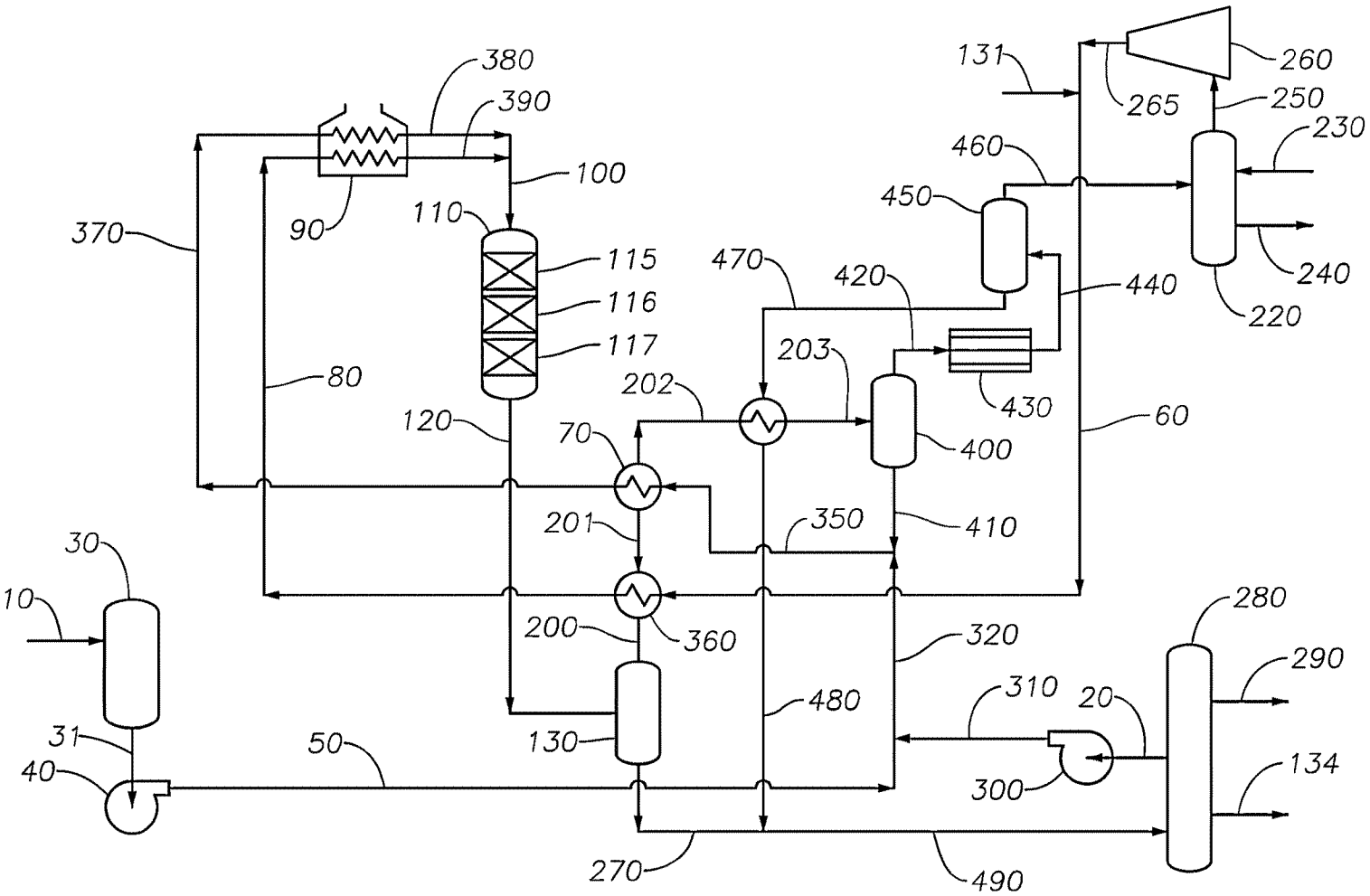

It may be desired to separate the total vapor product after separating the bottoms and mid-cut streams. FIG. 5 schematically illustrates an alternative embodiment for the method to produce a utility fluid useful in hydroprocessing pyrolysis tar. For ease of reference, process features of FIG. 5 that are similar to those in FIG. 4 are identified by the same index number. In this embodiment, the hydroprocessed effluent is conducted directly from hydroprocessing stage 110 via conduit 120 to separation stage 130 (in one embodiment, a flash drum). Relocating exchangers 70 and 360 from conduit 120 (as in FIG. 4) to conduit 200 (FIG. 5) increases the amount of vapor leaving separation stage 130 via conduit 200. A bottoms stream is separated in stage 130 from the hydroprocessed effluent and may be carried away via conduit 270.

The vapor leaving stage 130 is cooled in exchangers 360, 70, and 202*a*, to form vapor and liquid phases which are conducted via conduits 200, 201, 202, and 203 to separation stage 400 (in one embodiment, a flash drum). A mid-cut stream is separated in stage 400 and conducted via conduit 410. The remaining vapor is separated in stage 400 and conducted via conduit 420 to condenser 430 where it is further cooled to form, yet again, vapor and liquid phases. The vapor and liquid from condenser 430 are conducted via conduit 440 to separation stage 450 where a light (relative to the bottoms and mid-cut) liquid overhead stream is separated and conducted via conduit 470. The overhead stream 480 may be carried away separately or combined with bottoms stream 270 and carried away via conduit 490.

The vapor in separation stage 450 is separated to form a total vapor product. The total vapor product is conducted away from stage 450 via conduit 460 to upgrading stage 220, which comprises, e.g., one or more amine towers. Fresh amine is conducted to stage 220 via line 230, with rich amine conducted away via conduit 240. At least a portion of the upgraded treat gas is conducted away from stage 220 via conduit 250, compressed in compressor 260, and conducted via conduits 265, 60, 80, and 390 for re-cycle and re-use in the hydroprocessing stage 110.

The sum of the amounts of bottoms 270, mid-cut 410, and overhead 470 streams is the hydroprocessed product in this embodiment and equals about 95.0 wt % of the total liquid feed (combined primer fluid and tar stream from conduit 380) to hydroprocessing stage 110. The bottoms stream 270 comprises from 20 to 70 wt % of the hydroprocessed product. The overhead stream 470 comprises from 0 wt % to 20 wt % of the hydroprocessed product. The mid-cut stream 410 comprises from 20 to 70 wt % of the hydroprocessed product. As previously described, the flow of primer fluid via conduit 330 may be reduced or stopped and at least a portion of the mid-cut can be recycled via conduit 410 to be used as utility fluid.

Optionally, the bottoms 270, overhead 480, or both may be conducted via conduit 490 to separation stage 280 (in one embodiment, a fractionator). As desired, a trim portion of the material in stage 280 may be separated and combined, via conduits 20 and 310 and pump 300, with the tar stream 50 to supplement or augment the mid-cut utility fluid 410. Optional streams 290 and 134 may be separated as desired in separation stage 280.

Pre-Hydroprocessing a Primer Fluid to Produce a Utility Fluid

Another aspect of the invention is producing a utility fluid by pre-hydroprocessing the specified primer fluid without the presence of tar and using that utility fluid for pyrolysis tar hydroprocessing using the same hydroprocessing catalyst. Pre-hydroprocessing the primer fluid without the tar removes substantially all substituents having terminal unsaturates, for example, vinyl aromatics, from the primer fluid. This allows selection of primer fluids (for example, SCGO or SCN, which are readily available when the pyrolysis process involves steam cracking) that may contain undesirable terminal unsaturates, for example, vinyl aromatics. International Patent Application Publication No. W O2013/033590 discloses hydrotreating SCGO or SCN in different conventional hydrotreaters (e.g. not hydroprocessed with pyrolysis tar). However, providing separate facilities to hydroprocess the primer fluid and the tar separately represents significant added expense and complexity. One advantage of the present invention is it avoids this complexity and cost by using the same hydroprocessing facilities while removing the reactive terminal unsaturates including vinyl aromatics from the primer fluid to produce desirable utility fluid.

In an embodiment, the pre-hydroprocessed utility fluid comprises ≤10.0 wt %, for example, ≤5.0 wt %, ≤1.0 wt %, vinyl aromatics, based on the weight of the utility fluid.

In certain embodiments, the pre-hydroprocessed utility fluid comprises ≥1.0 wt % of 1.0 ring class compounds, ≥5.0 wt % of 1.5 ring class compounds, ≥5.0 wt % of 2.0 ring class compounds, and ≤0.1 wt % of 5.0 ring class compounds, where the weight percents are based on the weight of the pre-hydroprocessed utility fluid.

Referring again to FIG. 4, an embodiment of the invention includes providing a primer fluid, preferably SCGO or SCN, via conduit 330. In this embodiment, the primer fluid is conducted (alone) to preheat stage 90 via conduit 370. A treat gas comprising molecular hydrogen is obtained from conduits 131 and/or 265. The treat gas is conducted via conduit 60 to an exchanger 360, the heated treat gas being conducted to a pre-heat stage 90 via conduit 80. Pre-heated primer fluid (from conduit 380) is combined with the pre-heated treat gas (from conduit 390) and then conducted via conduit 100 to hydroprocessing stage 110. The primer fluid is pre-hydroprocessed in the presence of the treat gas and one or more of the specified hydroprocessing catalyst, the hydroprocessing catalyst being deployed within hydroprocessing stage 110 in at least one catalyst bed 115. Additional catalyst beds, e.g., 116, 117, etc., with intercooling quench using treat gas, from conduit 60 provided between beds, if desired.

Pre-hydroprocessed effluent is conducted away from stage 110 via conduit 120. Heat can be transferred from the hydroprocessed product to the treat gas and primer fluid via exchangers 360 and 70 respectively, as shown in FIG. 4. Following these exchangers, the pre-hydroprocessed effluent is conducted to a separation stage 130 for separating a first total vapor product (e.g., heteroatom vapor, vapor-phase cracked products, unused treat gas, etc.) and utility fluid (e.g., pre-hydroprocessed primer fluid) from the pre-hydroprocessed effluent. In one embodiment, separation stage 130 is a flash drum.

The first total vapor product is conducted away from stage 130 via conduit 200 to upgrading stage 220, which comprises, e.g., one or more amine towers. Fresh amine is conducted to stage 220 via line 230, with rich amine conducted away via conduit 240. At least a portion of the upgraded treat gas is conducted away from stage 220 via conduit 250, compressed in compressor 260, and conducted via conduit 265, 60, and 80 for re-cycle and re-use in the hydroprocessing stage 110. Treat gas, e.g., molecular hydrogen for starting up the process or for make-up, can be obtained from line 131 if needed.

The utility fluid is conducted away from stage 130 via conduit 270 to be collected in separation stage 280 or optional storage vessel (not shown). When a desired amount of utility fluid is produced, the flow of primer fluid to conduit 330 may be reduced or stopped. From this point, the pyrolysis tar hydroprocessing process may be progressed as described above except that instead of starting with primer fluid diluent, the pyrolysis tar hydroprocessing process will be started with utility fluid conducted from either separation stage 280 or optional storage vessel (not shown). Additionally, the pyrolysis tar hydroprocessing process uses the same hydroprocessing catalyst used to pre-hydroprocess the primer fluid.

Example 1

A 45.7 cm length of ⅜ inch (0.9525 cm) SS tubing was used as a reactor. The middle 34 cm is held at a near-isothermal temperature of 400° C. during the course of the experiment. The reactor was loaded with 18 $cm^3$ of a commercial NiMo oxide on alumina hydrotreating catalyst (RT-621).

The reactor was sulfided by flowing a 20 wt % solution of dimethyldisulfide in isopar M through the packed reactor at 0.042 mL/min for 1 hour at 100° C., then for 12 hours at 240° C., and finally for 60 hours at 340° C. The sulfiding procedure was performed while flowing 20 standard cubic centimers per minute (sccm) $H_2$ at 1000 psig of pressure.

100.0 wt % of a feedstock was provided to the reactor. The feedstock comprises 60.0 wt % of SCT (having properties of SCT-1 described in Table 1) conducted to the process and 40.0 wt % of primer fluid, the primer fluid comprising ≥98 wt % trimethyl-benzene, the weight percents being based on the weight of the feedstock. This corresponds to a utility fluid:tar stream weight ratio in the feedstock of 0.66. The feedstock was fed to the reactor at a weight hourly space velocity (WHSV) from 0.5 to 1.0 $hr^{-1}$. Additionally, molecular hydrogen was fed to reactor at a rate of 1500 standard cubic feet per barrel (scfb). Reactor pressure was held at 1000 psig.

The reactor was operated semi-continuously in the following sequence:

(a) A batch of tar and first/utility fluid feedstock was hydroprocessed as specified in the reactor.

(b) A total vapor product "offgas" was separated from the reactor effluent and discarded.

(c) The hydroprocessed product (liquid) was collected from each batch. The amount of hydroprocessed product is approximately 95.0 wt % of the total liquid feed to the reactor.

(d) The hydroprocessed product from each batch was separated using a rotary evaporator into overhead (5 to 10 wt %), mid-cut (40 to 50 wt %), and bottoms (40 to 50 wt %).

(e) The mid-cut from the previous batch was used as utility fluid for the subsequent batch. Excess mid-cut from each batch was discarded. Cycle 0 denotes the first batch using trimethyl-benzene as primer fluid.

Each batch required about 5 days to complete. The reactor was operated semi-continuously under substantially the specified conditions for 24 batches (or 120 days on stream derived from multiplying 24 batches*5 days/batch) with ≤1.0% increase in reactor pressure drop of over its start-of-run ("SOR") value, as calculated by ([Observed pressure drop−Pressure $drop_{SOR}$]/Pressure $drop_{SOR}$)*100%.

Figure 6A:
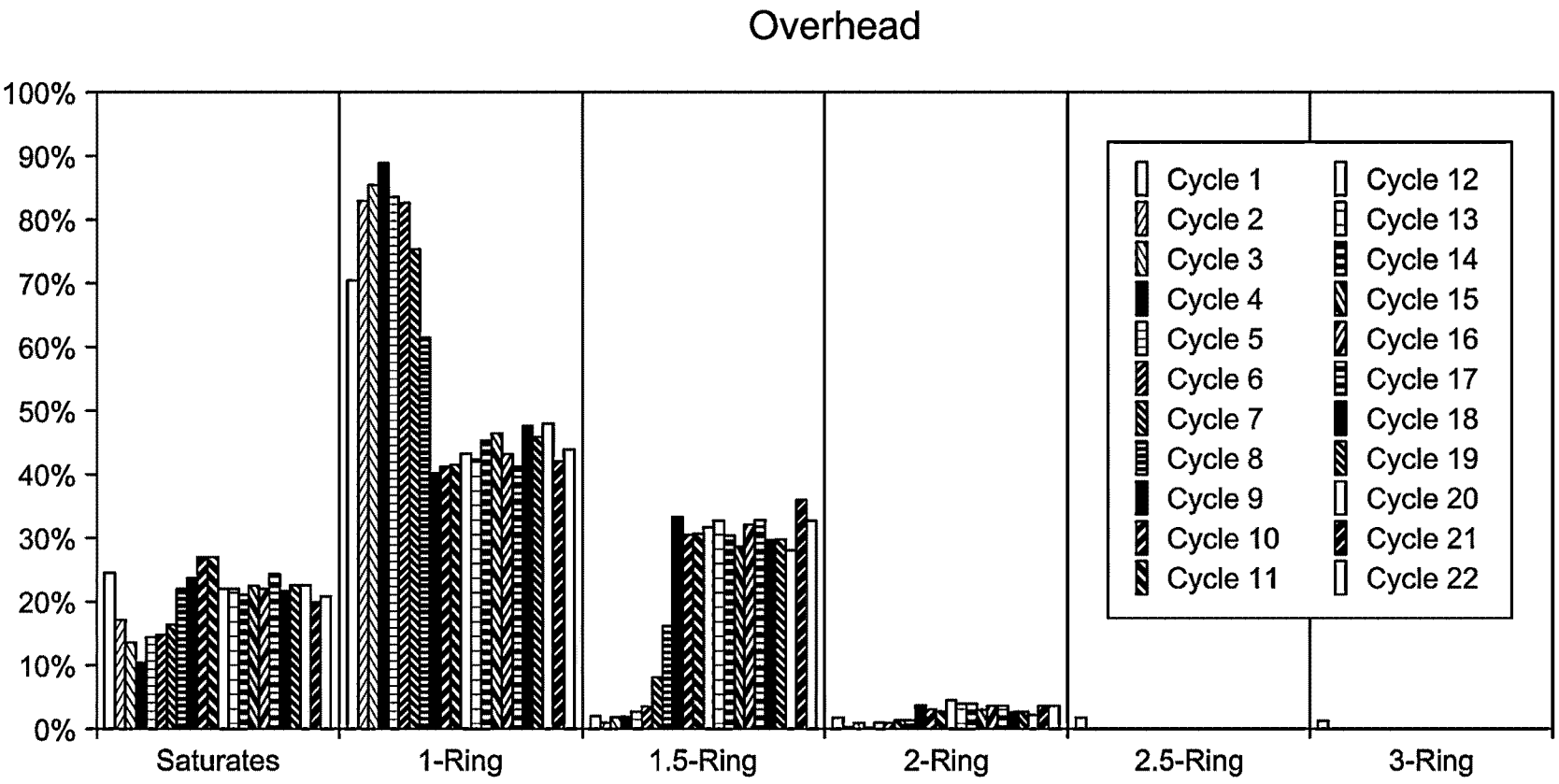
FIGS. 6A, 6B, and 6C summarize results of 2D GC analysis of three portions of pyrolysis tar hydroprocessed product.
Figure 6B:
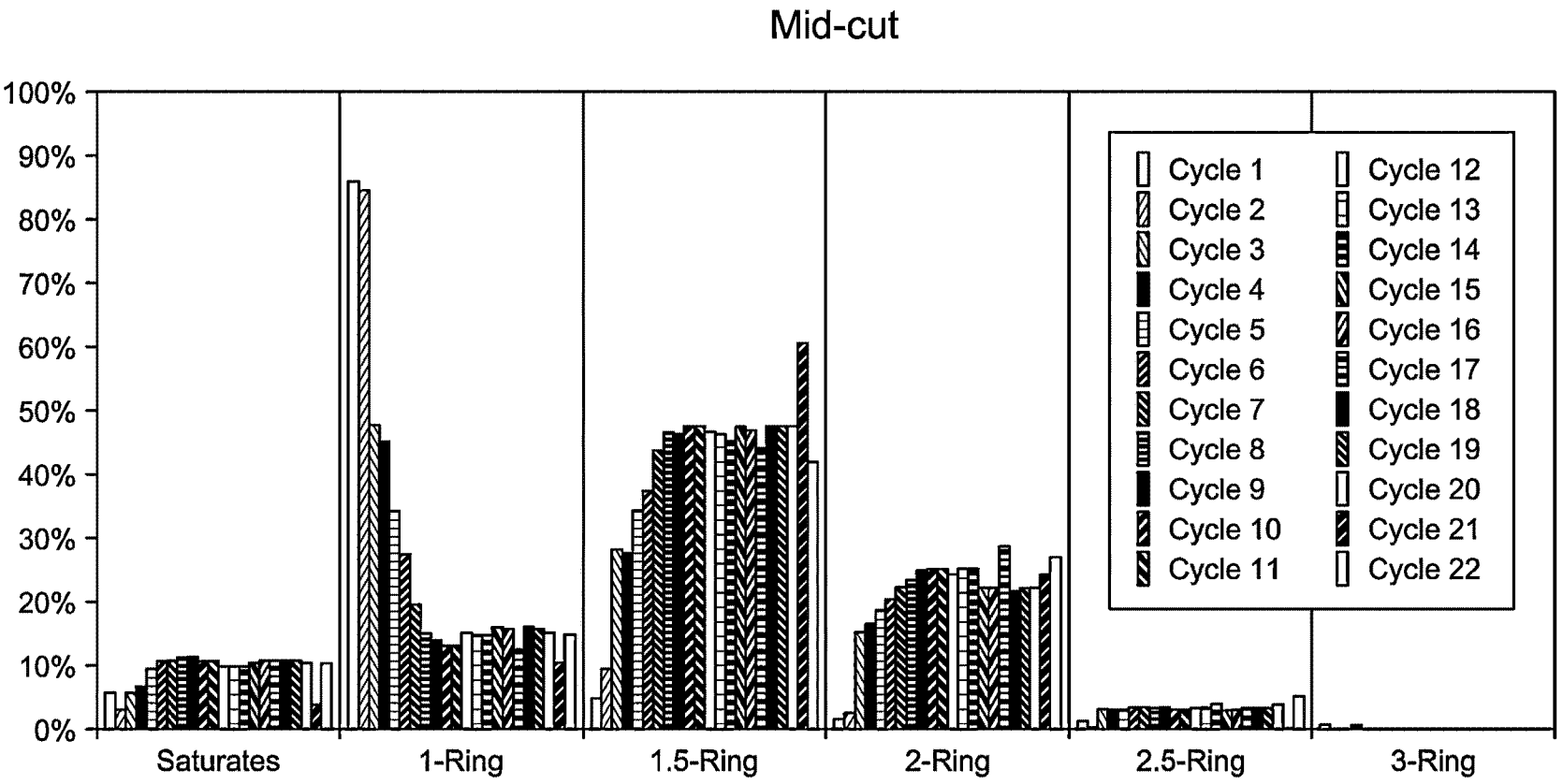
Figure 6C:
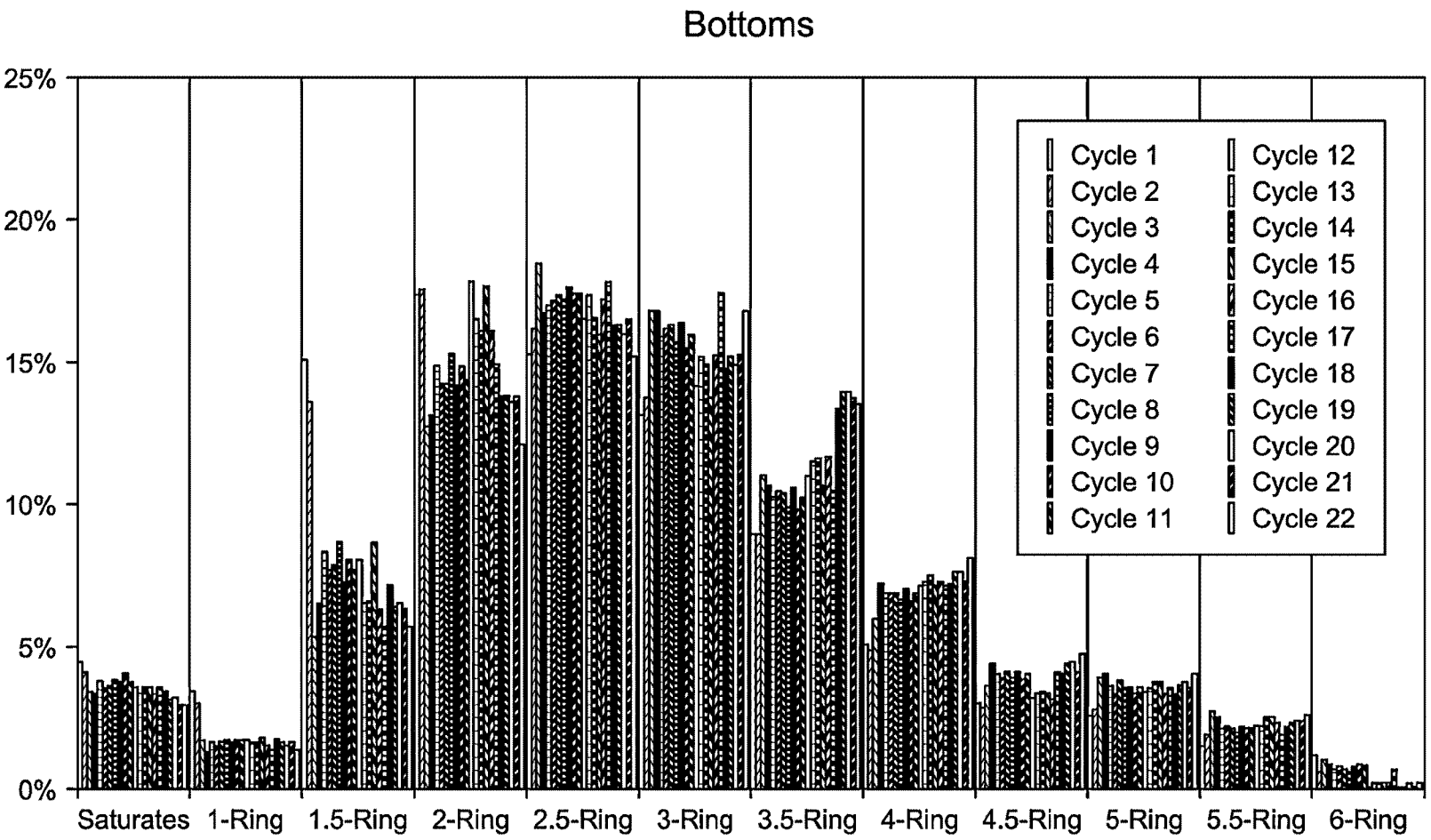

FIG. 6 summarizes results of 2D-GC analysis of the overhead, mid-cut, and bottoms compositions. Each bar represents wt % composition for a single one batch cycle. The product composition distribution reaches "steady state" after approximately 8 batch cycles. The batches prior to batch 8 are considered "startup" transitional batches. The mid-cut contained primarily 1.0 ring (about 10 wt % after batch 8), 1.5 ring (about 40 to 50 wt % after batch 8), and 2.0 ring (about 20 to 30 wt % after batch 8) molecular class compounds. The overhead contained mainly saturated hydrocarbons, 1.0 ring, and 1.5 ring molecular class compounds. Whereas, the bottoms consisted of a wide range of molecules. (Note: the 2D-GC utilized does not detect molecules boiling above 1050 degrees Farenheit which may affect the reported concentrations of the higher order rings).

Figure 7:
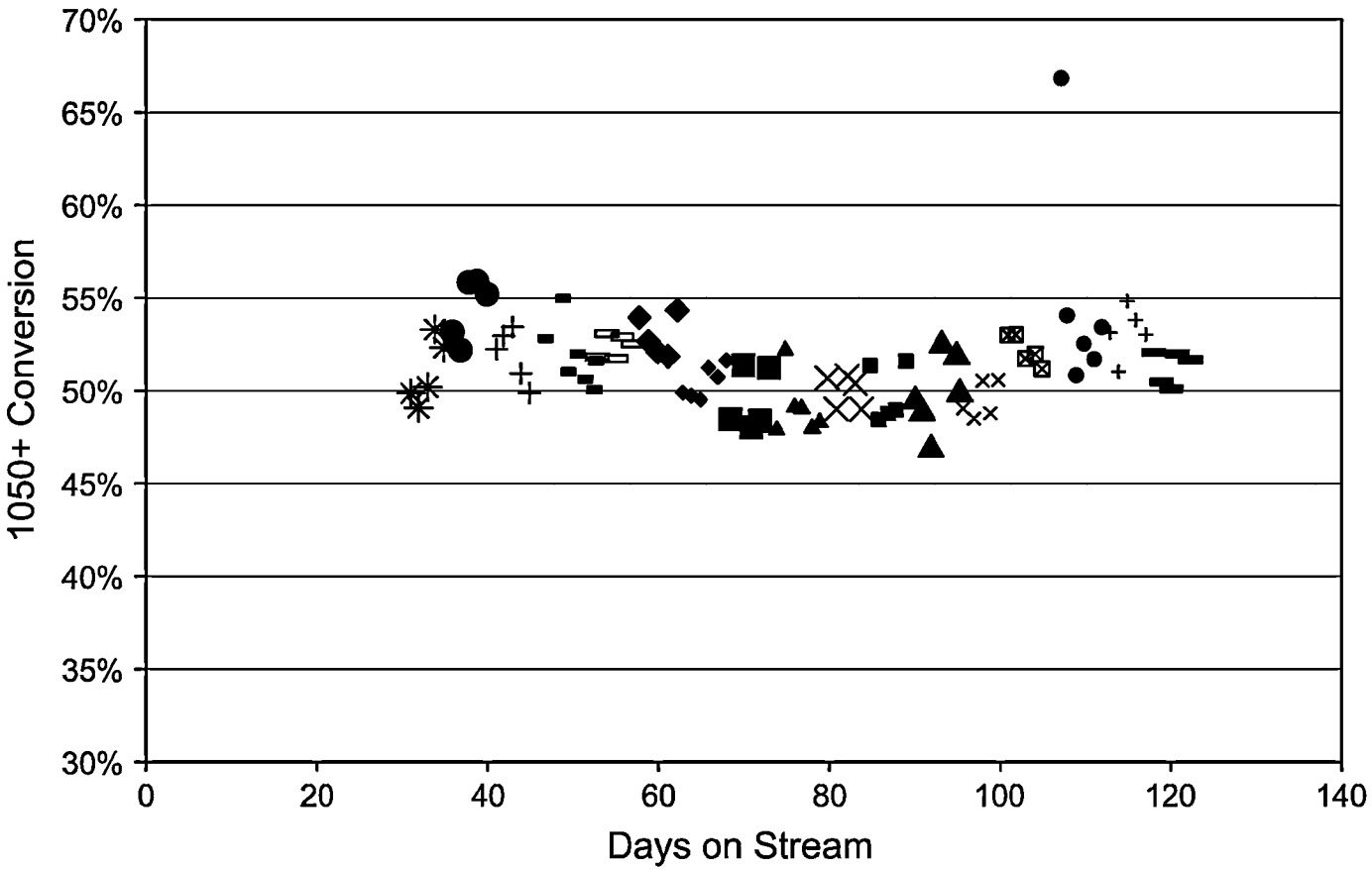
FIG. 7 illustrates conversion rate of molecules with boiling range 1050° F.+(565° C.+) in a pyrolysis tar hydroprocessing process.

The conversion of molecules with boiling range 1050° F.+ (565° C.+) is analogous to TH conversion. The simulated pyrolysis tar hydroprocessing process in Example 1 using mid-cut utility fluid had a relatively steady conversion as illustrated in FIG. 7. The 1050° F.+ (565° C.+) conversion ranged from about 46 to 56% as measured starting from the time startup transition ended at about 40 days on stream (after batch 8*5 days).

Figure 8:
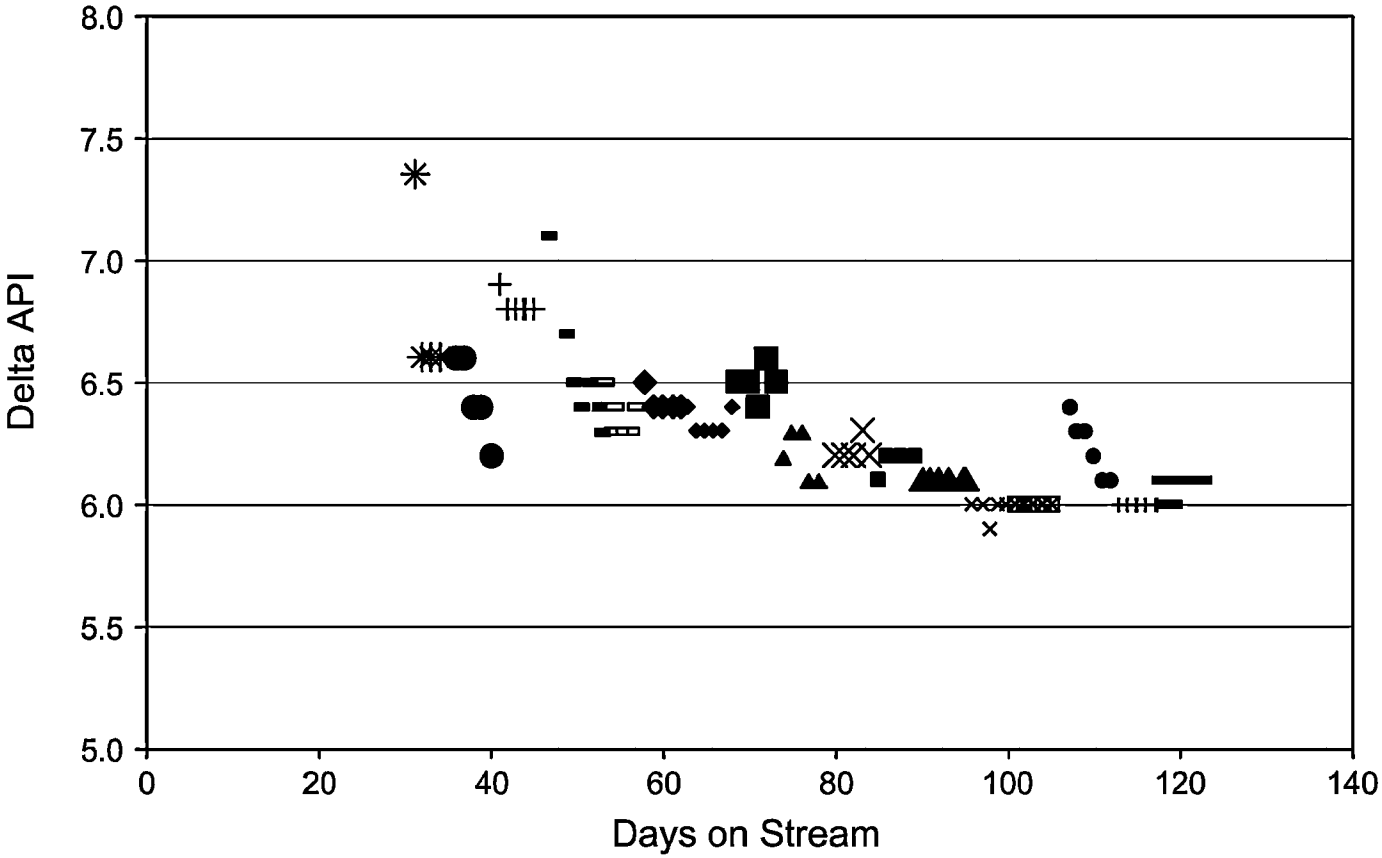
FIG. 8 illustrates the difference in API gravity between the combined feed and the hydroprocessed product from a pyrolysis tar hydroprocessing process.

FIG. 8 illustrates the difference in API gravity (degrees of API gravity) between the combined feed (tar+utility fluid) and the hydroprocessed product (total liquid product). A higher delta API indicates higher catalytic hydrogenation activity. The data using mid-cut utility fluid indicates acceptable delta API (from about day 40 to day 120 or from batch 8 to batch 24).

Figure 9:
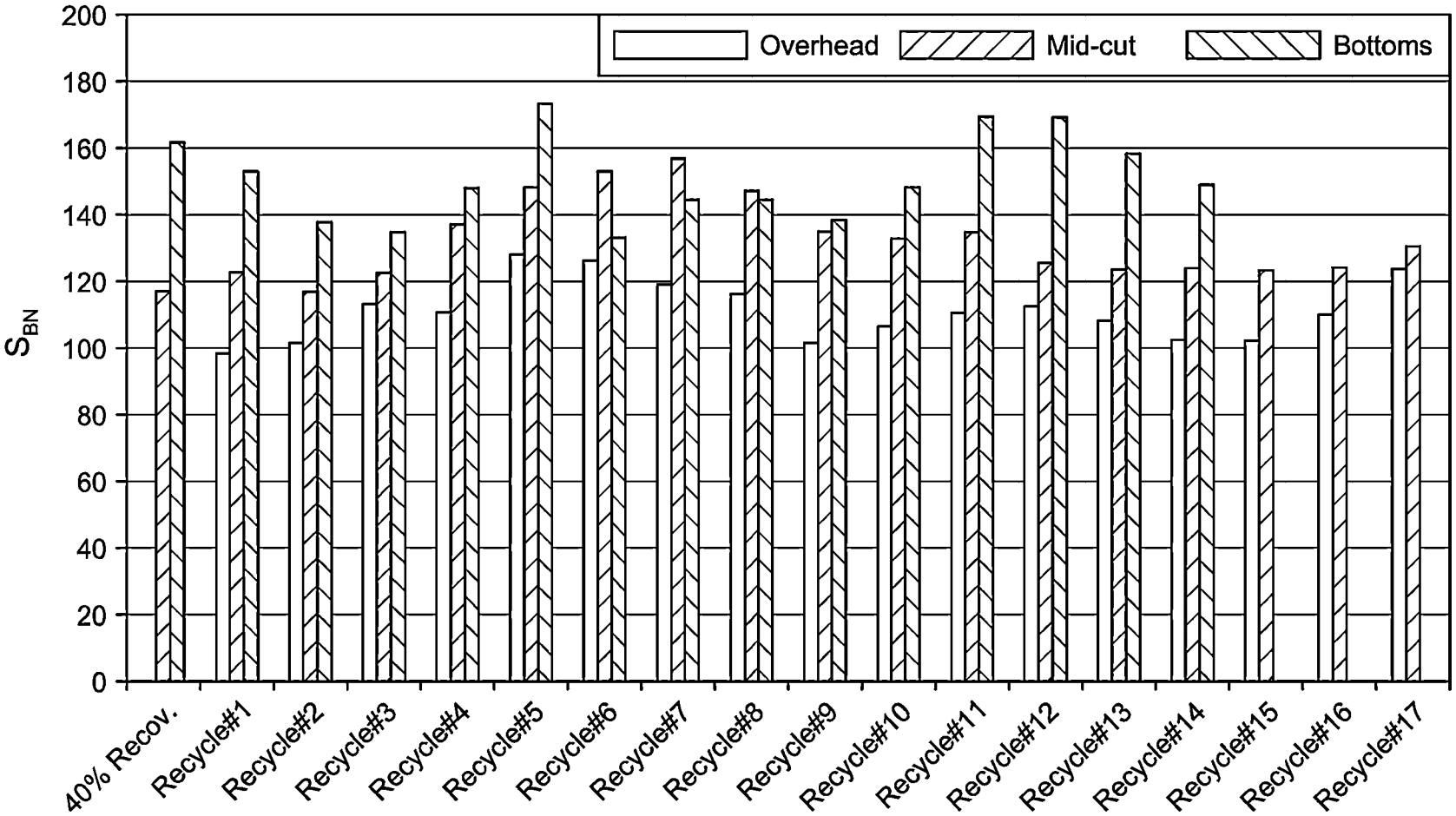
FIG. 9 illustrates the solubility blending number ($S_{BN}$) of three portions of pyrolysis tar hydroprocessed product.

FIG. 9 illustrates the solubility blending number ($S_{BN}$) of the overhead, mid-cut, and bottoms products. It is noted that the $S_{BN}$ of the mid-cut was ≥100 for all cycles (batches), ranging from $S_{BN}$ about 120 to 130 after batch 8. Note that the primer fluid, trimethyl-benzene, has a $S_{BN}$ of 95 indicating this method of producing mid-cut utility fluid can improve the $S_{BN}$ from the provided primer fluid. The higher the $S_{BN}$, the lower the probability of precipitating coke precursors that can cause significant pore blockage and eventually reactor plugging. The $S_{BN}$ of the bottoms was very high (≥145) for all cycles.

Example 2

A 56 cm length of ⅜ inch (0.9525 cm) SS tubing with a total volume of 20 $cm^3$ was used as a reactor. The middle 34 cm was held at a near-isothermal temperature of 350° C. during the course of the experiment. The volume of the hot zone was 14 $cm^3$. The entire reactor was loaded with 20 $cm^3$ of a commercial NiMo oxide on alumina hydrotreating catalyst (RT-621), and 5 $cm^3$ of 80 mesh silica to pack the interstitial spaces.

The reactor was sulfided by flowing a 20 wt % solution of dimethyldisulfide in isopar M through the packed reactor at 0.042 mL/min for 1 hour at 100° C., then for 12 hours at 240° C., and finally for 60 hours at 340° C. The sulfiding procedure was performed while flowing 20 standard cubic centimers per minute (sccm) $H_2$ at 1000 psig of pressure. After sulfiding completed, the flow of dimethyldisulfide was stopped.

Subsequent to sulfiding, the reactor temperature was raised to a temperature of 350° C. The molecular hydrogen flow was raised to 2400 standard cubic feet per barrel (scfb) or 94.5 sccm at 1000 psig. A primer fluid (SCGO) was fed at a liquid hourly space velocity (LHSV) of 2.5 $hr^{-1}$. A total vapor product "offgas" was separated from the reactor effluent and discarded. A liquid effluent (utility fluid) was collected which comprised approximately 95.0 wt % of the primer fluid fed to the reactor.

Figure 10:
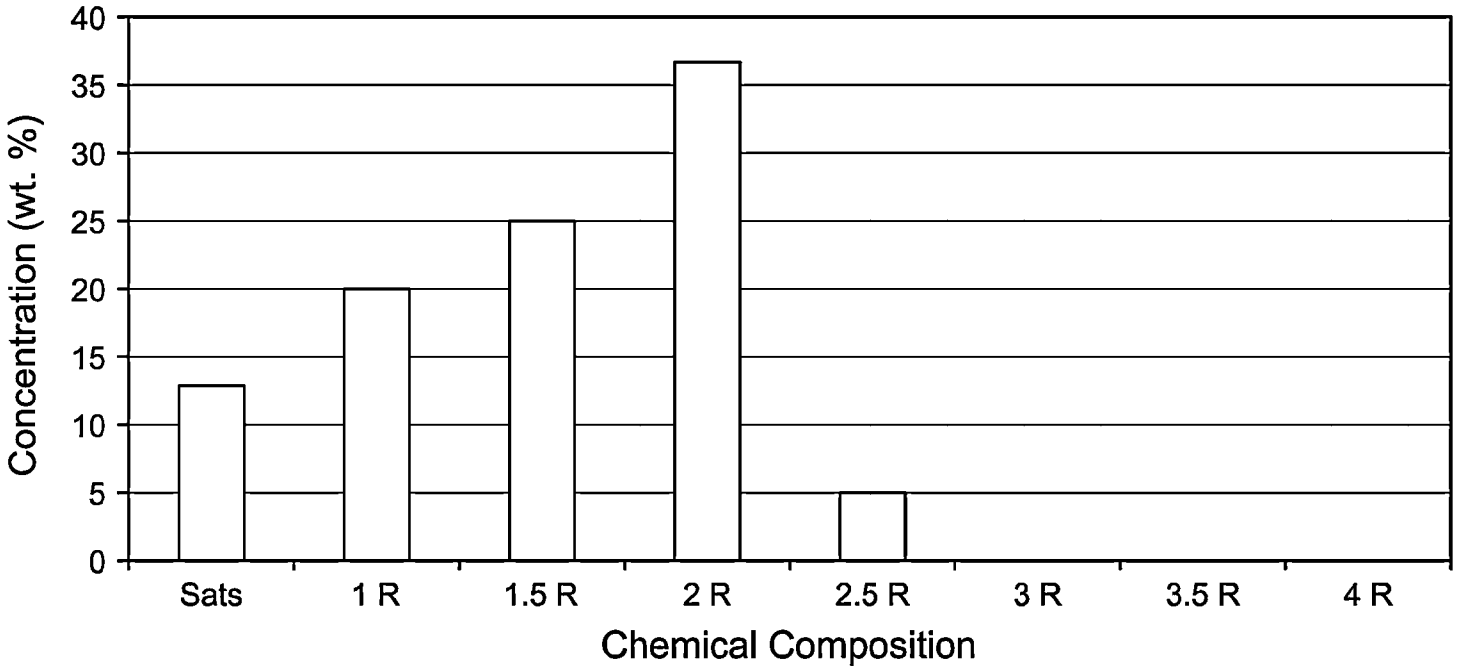
FIG. 10 depicts 2D GC composition analysis of a steam cracked gas oil ("SCGO") sample collected from an operating steam cracking process.

FIG. 10 depicts 2D-GC composition analysis of a SCGO sample collected from an operating steam cracking process. The composition of neat SCGO closely fits the composition of specified utility fluid making it a good candidate for pre-hydroprocessing to produce utility fluid.

Figure 11:
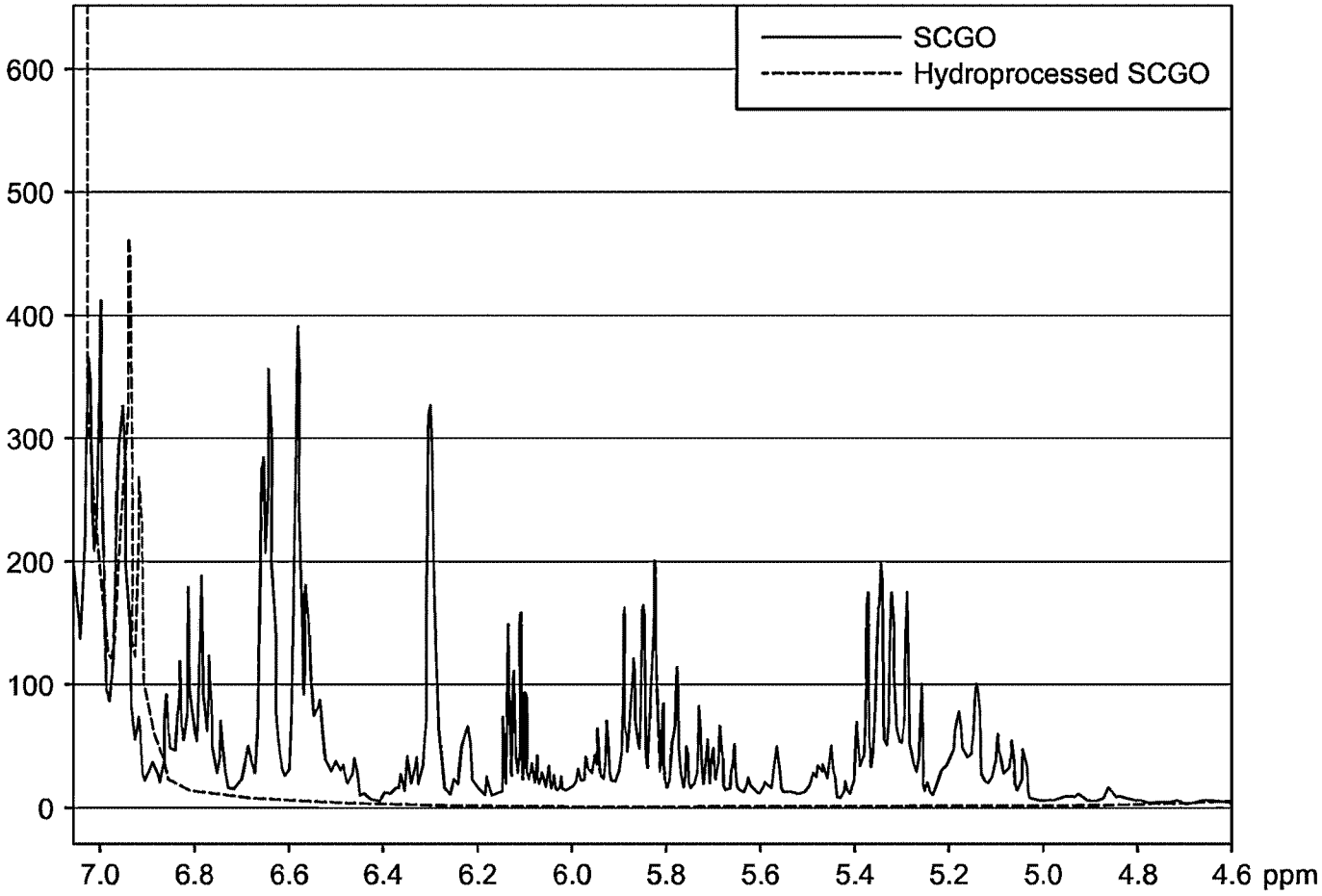
FIG. 11 presents $^1$H NMR analysis of SCGO and hydroprocessed SCGO.

FIG. 11 presents $^1H$ NMR analysis of neat SCGO and pre-hydroprocessed SCGO. $^1H$ NMR indicates the relative concentration (peak height) of various functional groups. The analysis indicates that neat SCGO has significant undesirable unsaturated functional groups in the olefinic region (e.g. terminal unsaturates such as those present in vinyl aromatics). After pre-hydroprocessing SCGO, the olefinic character (e.g., vinyl aromatics) is removed as indicated by absence of $^1H$ NMR peaks at: 6.0-5.6 ppm ($CH{=}CH_2$), 5.6-5.2 ppm (CH=CH), 5.2-5.0 ppm (CH=C), 5.0-4.8 ppm ($CH{=}CH_2$), 4.8-4.6 ppm ($C{=}CH_2$).

All patents, test procedures, and other documents cited herein, including priority documents, are fully incorporated by reference to the extent such disclosure is not inconsistent and for all jurisdictions in which such incorporation is permitted.

While the illustrative forms disclosed herein have been described with particularity, it will be understood that various other modifications will be apparent to and can be readily made by those skilled in the art without departing from the spirit and scope of the disclosure. Accordingly, it is not intended that the scope of the claims appended hereto be limited to the example and descriptions set forth herein, but rather that the claims be construed as encompassing all the features of patentable novelty which reside herein, including all features which would be treated as equivalents thereof by those skilled in the art to which this disclosure pertains.

When numerical lower limits and numerical upper limits are listed herein, ranges from any lower limit to any upper limit are contemplated.

TABLE 1

| | SCT 1 | SCT 2 |
|---|---|---|
| CARBON (wt %) | 89.9 | 91.3 |
| HYDROGEN (wt %) | 7.16 | 6.78 |
| NITROGEN (wt %) | 0.16 | 0.24 |
| OXYGEN (wt %) | 0.69 | N.M. |
| SULFUR (wt %) | 2.18 | 0.38 |
| Kinematic Viscosity at 50° C. (cSt) | 988 | 7992 |
| Weight % having an atmospheric boiling point ≥ 565° C. | 16.5 | 20.2 |
| Asphaltenes | 22.6 | 31.9 |
| NICKEL wppm | <0.7 | N.M.* |
| VANADIUM wppm | 0.22 | N.M. |
| IRON wppm | 4.23 | N.M. |
| Aromatic Carbon (wt %) | 71.9 | 75.6 |
| Aliphatic Carbon (wt %) | 28.1 | 24.4 |
| Methyls (wt %) | 11 | 7.5 |
| % C in long chains (wt %) | 0.7 | 0.63 |
| Aromatic H (wt %) | 38.1 | 43.5 |
| % Sat H (wt %) | 60.8 | 55.1 |
| Olefins (wt %) | 1.1 | 1.4 |

*N.M. = Not Measured

The invention claimed is:

1. A pyrolysis tar hydroprocessing process comprising:

(a) providing a first mixture comprising ≥10.0 wt % hydrocarbon;

(b) pyrolysing the first mixture to produce a second mixture comprising ≥1.0 wt % of $C_2$ unsaturates;

(c) separating a tar stream from the second mixture, wherein the tar stream includes ≥90 wt % of the second mixture's molecules having an atmospheric boiling point of ≥290° C.;

(d) providing a primer fluid, the primer fluid comprising (i) aromatic and non-aromatic ring compounds, (ii) vinyl aromatics, and having an ASTM D86 10% distillation point ≥60.0° C. and a 90% distillation point ≤350.0° C.;

($d_1$) hydroprocessing the primer fluid to produce a hydroprocessed primer fluid by contacting the primer fluid with at least one hydroprocessing catalyst under catalytic hydroprocessing conditions in the presence of molecular hydrogen;

(e) hydroprocessing the tar stream by contacting the tar stream with at least one hydroprocessing catalyst under catalytic hydroprocessing conditions in the presence of molecular hydrogen and in the presence of the hydroprocessed primer fluid to convert at least a portion of the tar stream to a hydroprocessed product; and (f) separating from the hydroprocessed product a mid-cut comprising from 20 to 70 wt % of the hydroprocessed product and having an ASTM D86 10% distillation point ≥60.0° C. and a 90% distillation point ≤350.0° C.; and (g) recycling at least a portion of the mid-cut and substituting the recycled mid-cut for at least a portion of the hydroprocessed primer fluid utilized in hydroprocessing the tar stream.

2. The process of claim 1, wherein the mid-cut comprises from 30 to 60 wt % of the hydroprocessed product.

3. The process of claim 1, wherein (i) the hydroprocessing is conducted continuously in a hydroprocessing zone from a first time $t_1$ to a second time $t_2$, $t_2$ being ≥($t_1$+10 days) and (ii) hydroprocessing zone's pressure drop at the second time is increased ≤10.0% over the pressure drop at the first time.

4. The process of claim 3, wherein (i) $t_2$ is ≥($t_1$+100 days) and (ii) hydroprocessing zone's pressure drop at the second time is increased ≤10.0% over the pressure drop at the first time.

5. The process of claim 1, wherein the first mixture's hydrocarbon comprises one or more of naphtha, gas oil, vacuum gas oil, waxy residues, atmospheric residues, residue admixtures, or crude oil.

6. The process of claim 1, wherein the second mixture's tar stream comprises (i) ≥10.0 wt % of molecules having an atmospheric boiling point ≥565° C. that are not asphaltenes, and (ii) ≤$1.0\times10^3$ ppmw metals, the weight percents being based on the weight of the second mixture's tar.

7. The process of claim 1, wherein the mid-cut of step (f) comprises ≥10.0 wt % aromatic and non-aromatic ring compounds, wherein, the mid-cut includes:

(a) ≥1.0 wt % of 1.0 ring class compounds comprising only one moiety selected from the group consisting of
(i) one aromatic ring and
(ii) two non-aromatic rings;

(b) ≥5.0 wt % of 1.5 ring class compounds comprising only one moiety selected from the group consisting of
(i) one aromatic ring and one non-aromatic ring, and
(ii) three non-aromatic rings;

(c) ≥5.0 wt % of 2.0 ring class compounds comprising only one moiety selected from the group consisting of
(i) two aromatic rings,
(ii) one aromatic ring and two non-aromatic rings, and
(iii) four non-aromatic rings; and (d) ≤0.1 wt % of 5.0 ring class compounds comprising only one moiety selected from the group consisting of
(i) five aromatic rings,
(ii) four aromatic rings and two non-aromatic rings,
(iii) three aromatic rings and four non-aromatic rings,
(iv) two aromatic rings and six non-aromatic rings,
(v) one aromatic ring and eight non-aromatic rings and
(vi) ten non-aromatic rings, where the weight percents are based on the weight of the mid-cut.

8. A pyrolysis tar hydroprocessing process comprising:

(a) providing a primer fluid, the primer fluid comprising (i) aromatic and non-aromatic ring compounds, (ii) vinyl aromatics, and having an ASTM D86 10% distillation point ≥60.0° C. and a 90% distillation point ≤350.0° C.;

(b) hydroprocessing the primer fluid to produce a hydroprocessed primer fluid by contacting the primer fluid with at least one hydroprocessing catalyst under catalytic hydroprocessing conditions in the presence of molecular hydrogen;

(c) providing a first mixture comprising ≥10.0 wt % hydrocarbon based on the weight of the first mixture;

(d) pyrolysing the first mixture to produce a second mixture comprising ≥1.0 wt % of $C_2$ unsaturates, based on the weight of the second mixture;

(e) separating a tar stream from the second mixture, wherein the tar stream includes ≥90 wt % of the second mixture's molecules having an atmospheric boiling point of ≥290° C.; and hydroprocessing the tar stream by contacting the tar stream with the same hydroprocessing catalyst under catalytic hydroprocessing conditions in the presence of molecular hydrogen and the hydroprocessed primer fluid to convert at least a portion of the tar stream to a hydroprocessed product.

9. The process of claim 8, wherein the primer fluid comprises steam cracked gas oil.

10. The process of claim 8, wherein the hydroprocessed primer fluid comprises ≤10.0 wt % vinyl aromatics, based on the weight of the hydroprocessed primer fluid.

11. The process of claim 8, wherein the hydroprocessed primer fluid comprises ≤1.0 wt % vinyl aromatics, based on the weight of the hydroprocessed primer fluid.

12. The process of claim 8, wherein the hydroprocessed primer fluid of step (b) comprises ≥10.0 wt % aromatic and non-aromatic ring compounds, wherein, the hydroprocessed primer fluid includes:

(a) ≥1.0 wt % of 1.0 ring class compounds comprising only one moiety selected from the group consisting of
(i) one aromatic ring, and
(ii) two non-aromatic rings;

(b) ≥5.0 wt % of 1.5 ring class compounds comprising only one moiety selected from the group consisting of
(i) one aromatic ring and one non-aromatic ring, and
(ii) three non-aromatic rings;

(c) ≥5.0 wt % of 2.0 ring class compounds comprising only one moiety selected from the group consisting of
(i) two aromatic rings,
(ii) one aromatic ring and two non-aromatic rings, and
(iii) four non-aromatic rings; and (d) ≤0.1 wt % of 5.0 ring class compounds comprising only one moiety selected from the group consisting of
(i) five aromatic rings, (ii) four aromatic rings and two non-aromatic rings, (iii) three aromatic rings and four non-aromatic rings, (iv) two aromatic rings and six non-aromatic rings, (v) one aromatic ring and eight non-aromatic rings, and (vi) ten non-aromatic rings, where the weight percents are based on the weight of the hydroprocessed primer fluid.

* * * * *